US008519988B2

(12) United States Patent
Ishihara

(10) Patent No.: US 8,519,988 B2
(45) **Date of Patent: *Aug. 27, 2013**

(54) DISPLAY DEVICE AND DRIVE CONTROL DEVICE THEREOF, SCAN SIGNAL LINE DRIVING METHOD, AND DRIVE CIRCUIT

(75) Inventor: Tomoyuki Ishihara, Tenri (JP)

(73) Assignee: Sharp Kabushiki Kaisha, Osaka (JP)

( * ) Notice: Subject to any disclaimer, the term of this patent is extended or adjusted under 35 U.S.C. 154(b) by 883 days.

This patent is subject to a terminal disclaimer.

(21) Appl. No.: 11/887,226

(22) PCT Filed: Jun. 12, 2006

(86) PCT No.: PCT/JP2006/311712

§ 371 (c)(1),
(2), (4) Date: Sep. 27, 2007

(87) PCT Pub. No.: WO2006/134853

PCT Pub. Date: Dec. 21, 2006

(65) Prior Publication Data

US 2009/0174689 A1 Jul. 9, 2009

(30) Foreign Application Priority Data

Jun. 13, 2005 (JP) ..... 2005-172985

(51) Int. Cl.
*G09G 5/00* (2006.01)

(52) U.S. Cl.
USPC ..... 345/204; 345/89; 345/690

(58) Field of Classification Search
USPC ..... 345/204, 690–692, 208, 87, 89, 98–100, 345/76, 82, 103
See application file for complete search history.

(56) References Cited

U.S. PATENT DOCUMENTS

| | | | |
|---|---|---|---|
| 5,376,944 | A | 12/1994 | Mogi et al. |
| 6,229,515 | B1 | 5/2001 | Itoh et al. |
| 6,417,829 | B1 | 7/2002 | Jung et al. |
| 6,429,836 | B1 | 8/2002 | Hansen |

(Continued)

FOREIGN PATENT DOCUMENTS

| | | |
|---|---|---|
| JP | 01-188181 | 7/1989 |
| JP | 04-302289 | 10/1992 |

(Continued)

OTHER PUBLICATIONS

USPTO Notice of Panel Decision from Pre-Appeal Brief Review dated Aug. 8, 2011 in U.S. Appl. No. 12/923,132.

(Continued)

*Primary Examiner* — Stephen Sherman
(74) *Attorney, Agent, or Firm* — Harness, Dickey & Pierce, P.L.C.

(57) ABSTRACT

In one embodiment of the present invention, an image displaying period of a $1^{st}$ subframe of an $N^{th}$ frame is partially overlapped with an image displaying period of a $2^{nd}$ subframe of the $N^{th}$ frame and an image displaying period of a $2^{nd}$ subframe of an $(N-1)^{th}$ frame. For each of the subframes, a period of writing a pixel voltage into all horizontal lines in a display screen equals an image signal input period for inputting a single frame of the image signal. A delay period from (i) inputting of the $N^{th}$ frame of the image signal for the horizontal lines to (ii) writing of the pixel voltage into the horizontal lines in the $1^{st}$ subframe of the $N^{th}$ frame is made as short as possible.

24 Claims, 8 Drawing Sheets

(56) References Cited

U.S. PATENT DOCUMENTS

| | | | | |
|---|---|---|---|---|
| 6,603,468 | B2 | 8/2003 | Ooishi et al. | |
| 8,026,934 | B2 * | 9/2011 | Tomizawa et al. | 345/690 |
| 2001/0038369 | A1 | 11/2001 | Adachi et al. | |
| 2001/0052886 | A1 | 12/2001 | Ikeda | |
| 2002/0003520 | A1 | 1/2002 | Aoki | |
| 2002/0018057 | A1 * | 2/2002 | Sano | 345/204 |
| 2002/0044140 | A1 | 4/2002 | Inukai | |
| 2002/0140712 | A1 | 10/2002 | Ouchi et al. | |
| 2003/0006952 | A1 | 1/2003 | Hong | |
| 2003/0011549 | A1 | 1/2003 | Murahashi et al. | |
| 2003/0011614 | A1 | 1/2003 | Itoh et al. | |
| 2003/0048247 | A1 | 3/2003 | Ham | |
| 2003/0156092 | A1 | 8/2003 | Suzuki et al. | |
| 2003/0218587 | A1 | 11/2003 | Ikeda | |
| 2004/0017343 | A1 | 1/2004 | Adachi et al. | |
| 2004/0075631 | A1 | 4/2004 | Ishiguchi | |
| 2004/0155847 | A1 | 8/2004 | Taoka et al. | |
| 2004/0160406 | A1 * | 8/2004 | Yamazaki et al. | 345/100 |
| 2004/0196229 | A1 | 10/2004 | Ham | |
| 2004/0196274 | A1 | 10/2004 | Song et al. | |
| 2005/0156843 | A1 | 7/2005 | Itoh et al. | |
| 2005/0162360 | A1 | 7/2005 | Ishihara et al. | |
| 2005/0253785 | A1 | 11/2005 | Miyasaka et al. | |
| 2006/0017663 | A1 * | 1/2006 | Yamamoto et al. | 345/75.2 |

FOREIGN PATENT DOCUMENTS

| | | |
|---|---|---|
| JP | 05-150743 | 6/1993 |
| JP | 09-159999 | 6/1997 |
| JP | 09-204159 | 8/1997 |
| JP | 11-311980 | 11/1999 |
| JP | 2000322018 A * | 11/2000 |
| JP | 2001-281625 | 10/2001 |
| JP | 2001-343956 | 12/2001 |
| JP | 2002-23696 | 1/2002 |
| JP | 2002-023707 | 1/2002 |
| JP | 3295437 | 4/2002 |
| JP | 2002-132224 | 5/2002 |
| JP | 2002-297094 | 10/2002 |
| JP | 2003-022061 | 1/2003 |
| JP | 2003-84742 | 3/2003 |
| JP | 2003-241721 | 8/2003 |
| JP | 2003-280603 | 10/2003 |
| JP | 2004-240317 | 8/2004 |
| JP | 2004-279595 | 10/2004 |
| JP | 2005-173387 | 6/2005 |
| JP | 2005-173573 | 6/2005 |

OTHER PUBLICATIONS

US Office Action dated Feb. 18, 2011 for corresponding U.S. Appl. No. 12/923,132.

U.S. Advisory Action dated May 17, 2011 in U.S. Appl. No. 12/923,132.

U.S. Office Action dated Nov. 16, 2010 for corresponding U.S. Appl. No. 12/923,132.

Office Action dated Dec. 9, 2011, issued in U.S. Appl. No. 12/923,132.

U.S. Office Action dated Apr. 5, 2012, issued in U.S. Appl. No. 12/923,132.

U.S. Office Action dated Jan. 31, 2011, issued in U.S. Appl. No. 11/990,018.

U.S. Notice of Allowance dated May 26, 2011, issued in U.S. Appl. No. 11/990,018.

* cited by examiner

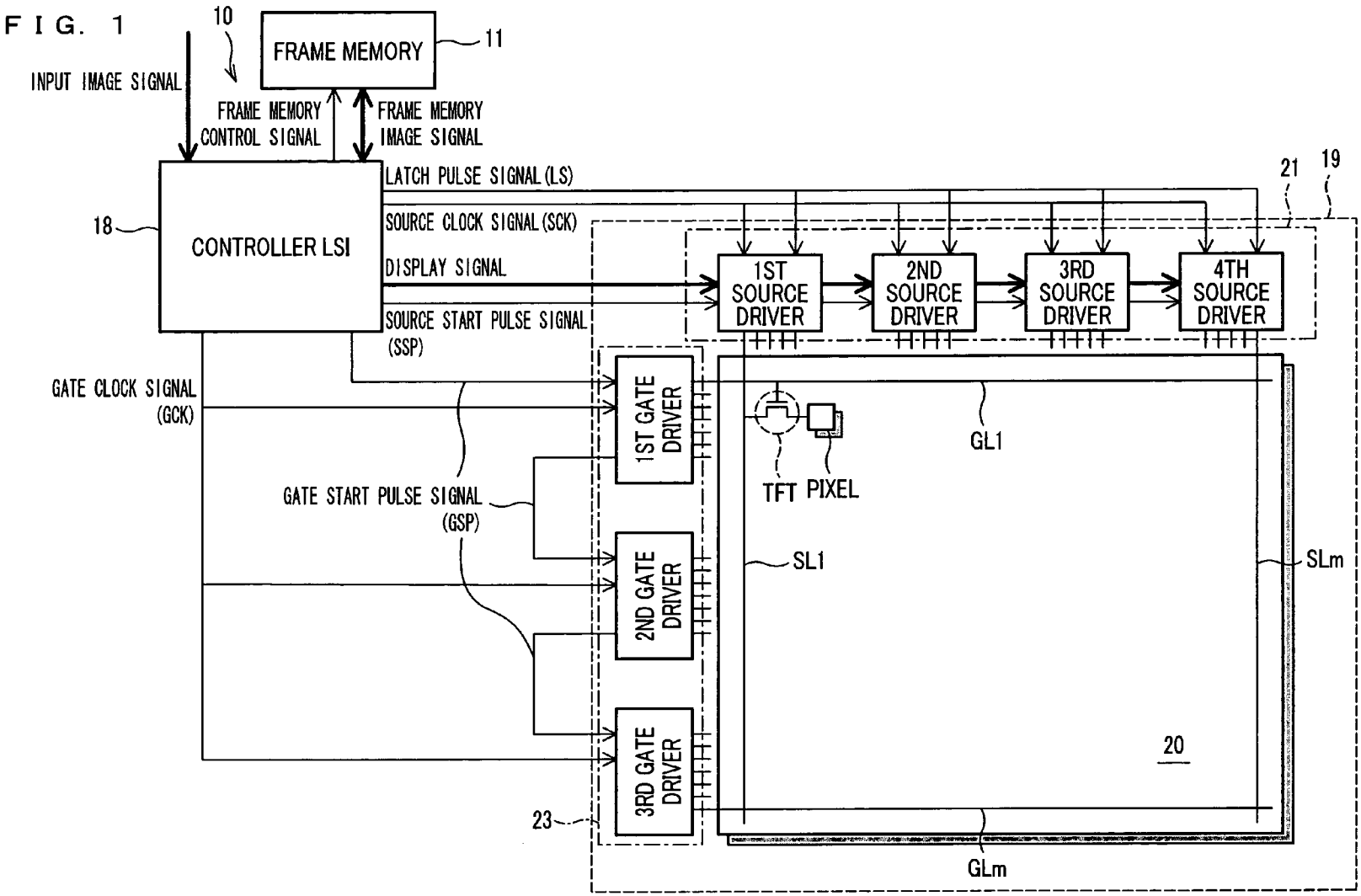
FIG. 1
INPUT IMAGE SIGNAL
10
FRAME MEMORY
11
FRAME MEMORY CONTROL SIGNAL
FRAME MEMORY IMAGE SIGNAL
CONTROLLER LSI
18
LATCH PULSE SIGNAL (LS)
SOURCE CLOCK SIGNAL (SCK)
DISPLAY SIGNAL
SOURCE START PULSE SIGNAL (SSP)
GATE CLOCK SIGNAL (GCK)
GATE START PULSE SIGNAL (GSP)
1ST SOURCE DRIVER
2ND SOURCE DRIVER
3RD SOURCE DRIVER
4TH SOURCE DRIVER
21
19
1ST GATE DRIVER
2ND GATE DRIVER
3RD GATE DRIVER
23
TFT PIXEL
SL1
GL1
SLm
GLm
20

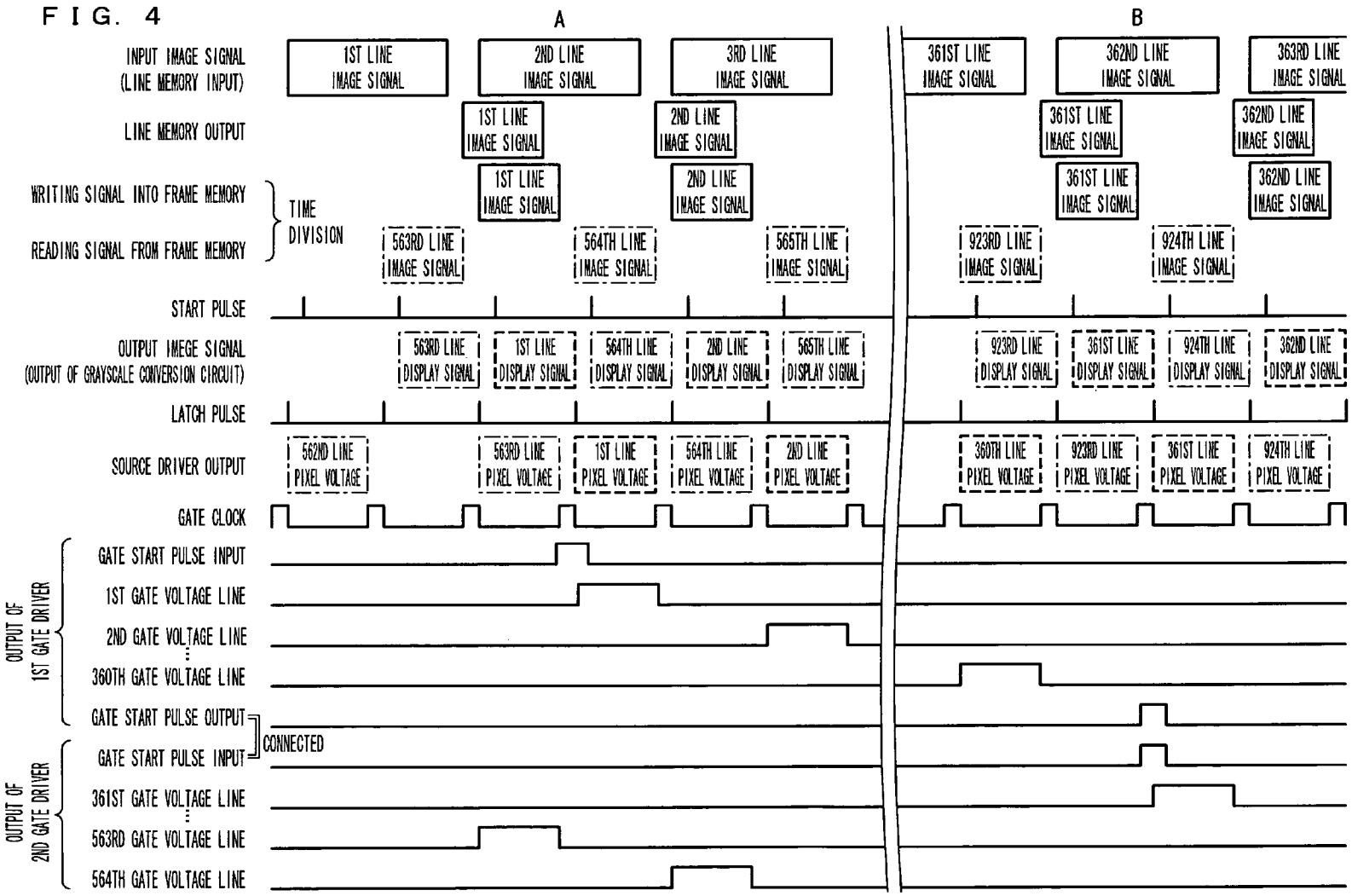
FIG. 4
A
B
INPUT IMAGE SIGNAL (LINE MEMORY INPUT)
LINE MEMORY OUTPUT
WRITING SIGNAL INTO FRAME MEMORY
READING SIGNAL FROM FRAME MEMORY
TIME DIVISION
START PULSE
OUTPUT IMEGE SIGNAL (OUTPUT OF GRAYSCALE CONVERSION CIRCUIT)
LATCH PULSE
SOURCE DRIVER OUTPUT
GATE CLOCK
GATE START PULSE INPUT
1ST GATE VOLTAGE LINE
2ND GATE VOLTAGE LINE
360TH GATE VOLTAGE LINE
GATE START PULSE OUTPUT
CONNECTED
GATE START PULSE INPUT
361ST GATE VOLTAGE LINE
563RD GATE VOLTAGE LINE
564TH GATE VOLTAGE LINE
OUTPUT OF 1ST GATE DRIVER
OUTPUT OF 2ND GATE DRIVER
1ST LINE IMAGE SIGNAL
2ND LINE IMAGE SIGNAL
3RD LINE IMAGE SIGNAL
361ST LINE IMAGE SIGNAL
362ND LINE IMAGE SIGNAL
363RD LINE IMAGE SIGNAL
563RD LINE IMAGE SIGNAL
564TH LINE IMAGE SIGNAL
565TH LINE IMAGE SIGNAL
923RD LINE IMAGE SIGNAL
924TH LINE IMAGE SIGNAL
563RD LINE DISPLAY SIGNAL
1ST LINE DISPLAY SIGNAL
564TH LINE DISPLAY SIGNAL
2ND LINE DISPLAY SIGNAL
565TH LINE DISPLAY SIGNAL
923RD LINE DISPLAY SIGNAL
361ST LINE DISPLAY SIGNAL
924TH LINE DISPLAY SIGNAL
362ND LINE DISPLAY SIGNAL
563RD LINE PIXEL VOLTAGE
1ST LINE PIXEL VOLTAGE
564TH LINE PIXEL VOLTAGE
2ND LINE PIXEL VOLTAGE
565TH LINE PIXEL VOLTAGE
360TH LINE PIXEL VOLTAGE
923RD LINE PIXEL VOLTAGE
361ST LINE PIXEL VOLTAGE
924TH LINE PIXEL VOLTAGE

ORDINARY TIME-DIVISIONAL DRIVING
(A FRAME IS DIVIDED INTO 2 SUBFRAMES)

DISPLAY DEVICE AND DRIVE CONTROL DEVICE THEREOF, SCAN SIGNAL LINE DRIVING METHOD, AND DRIVE CIRCUIT

TECHNICAL FIELD

The present invention relates to a display device which displays a frame of an image by (i) dividing a single frame for displaying a single image into plural subframes and (ii) displaying an image of each of the plural subframes for a single frame period.

BACKGROUND ART

In recent years, hold-type display devices provided with a liquid crystal module or an EL display module are increasingly used in the fields where CRTs (Cathode Ray Tubes) have been used.

However, it is said that the quality of video in such a hold-type display device falls behind that of an impulse-type display device such as CRTs (Cathode Ray Tubes) in which a light-up period during which an image is displayed and a light-off period during which an image is displayed are repeatedly alternated.

In other words, in a typical hold-type display device, the entire one frame period is the light-up period. As such, when a frame image is refreshed, the displayed object stays in the same position and is displayed until the image is refreshed to the next frame image. In the eyes of the viewers, this looks as a blurry motion.

Aiming at improvement of video quality as one of objects, various subframe-displaying methods of in which a frame for displaying a single image is divided into plural subframes have been suggested. For example, patent citations 1 to 4 discloses such methods.

Further, in an image display device adopting an organic LED panel, multiplexing of vertical scanning have been conventionally conducted.

[Patent Citation 1]
Japanese Unexamined Patent Publication No. 302289/1994 (Tokukaihei 4-302289; Published on Oct. 26, 1994)
[Patent Citation 2]
Japanese Unexamined Patent Publication No. 281625/2001 (Tokukai 2001-281625; Published on Oct. 10, 2001)
[Patent Citation 3]
Japanese Unexamined Patent Publication No. 23707/2002 (Tokukai 2002-23707; Published on Jan. 25, 2002)
[Patent Citation 4]
Japanese Unexamined Patent Publication No. 22061/2003 (Tokukai 2003-22061; Published on Jan. 24, 2003)
[Patent Citation 5]
Japanese Unexamined Patent Publication No. 297094/2002 (Tokukai 2002-297094; Published on Oct. 9, 2002)

DISCLOSURE OF INVENTION

However, in the conventional subframe displaying, there is a time lag between inputting of an image signal to a display device and actual displaying of an image, and the cost for a frame memory for storing an image signal is high.

In other words, in the conventional subframe displaying, an input image signal is stored in a frame memory once. Then, a display signal of each subframe is generated by reading out the stored image signal.

FIG. 8 shows an example of conventional subframe displaying. In this example, an image signal of an $N^{th}$ frame is input, and then a display signal of a $1^{st}$ subframe and a display signal of a $2^{nd}$ subframe are output in a time-divisional manner. Further, the display signal of the $2^{nd}$ subframe is output after the display signal of the $1^{st}$ subframe is output.

In this driving method, there will be a time lag, which is substantially equivalent to a single frame period, between inputting of the image signal and outputting of a display signal (including display signals of plural subframes). Thus, in a case where the vertical frequency (frame rate) of the image signal is 60 Hz, the time lag will be about 16 ms.

In a case of using the display device in a television receiver or the like, the time lag between the inputting of the image signal and the outputting of the display signal leads to a problem of a displayed image and sound being out of sync with each other. This necessitates a circuit or the like which solves the problem of the sound being out of sync. Further, in a case of using the display device as an image display device for a machine such as a personal computer, gaming machine, or the like requiring immediate updating of image displaying in response to an input operation, there will be a significant time lag in relation to an operation. This results in less comfortable operation of the machine.

Further, in the driving method shown in FIG. 8, the already-written image signal of the $N^{th}$ frame has to be read out (for the $2^{nd}$ time) while writing an image signal of an $N+1^{th}$ frame (a frame next to the $N^{th}$ frame). Accordingly, the frame memory for storing an input image signal requires a memory size that covers two screens (2 frames) for both storing and reading out the image signal.

Further, since the respective display signals of the $1^{st}$ and $2^{nd}$ subframes are both generated by reading out the image signal stored in the frame memory, it is necessary to write an input of a single screen into the frame memory while reading out an output of two screens at a double speed. This necessitates a large memory bandwidth. Specifically, where: transfer frequency (dot-clock frequency) of an input image signal is F (Hz); and the number of data bits per pixel is D, a required memory bandwidth for writing an input of one screen while reading out an output of two screens at a double-speed is FD+(2F)D*2=5FD (bps).

An increase in the memory bandwidth causes an increase in a clock frequency for memory accessing, or necessitates an increase in the number of terminals of the memory. Either cases will increase the power consumption, and an increase in the costs.

Here, Patent Citation 5 describes multiplexing of vertical scanning. However, since Patent Citation 5 regards driving of an organic LED panel controlled by a binary voltage, it is not applicable to a multiple-grayscale image display device. Therefore, Patent Citation 5 does not solve the foregoing problems.

The present invention is made in view of the above problems, and it is an object of the present invention to provide a displaying method and a drive control device or the like for a display device which causes less time lag between inputting of an image signal and displaying of an image even if a frame is divided into subframes in time of driving, and which restrains the cost for a frame memory for storing an input image signal.

In order to achieve the foregoing object, a displaying method of the present invention is a method of displaying an image in which a single frame of an input image signal is divided into $1^{st}$ to nth subframes (where n is an integer of not less than 2) in a time-divisional manner, wherein: a period of displaying an image of a $1^{st}$ subframe of an $N^{th}$ frame (N is an integer of not less than 2) overlaps at least (i) a part of a period of displaying an image based on the $2^{nd}$ subframe of the $N^{th}$ frame and (ii) a part of a period of displaying an image based on the nth subframe of an $(N-1)^{th}$ frame, and for each of the subframes, a period of writing a pixel voltage into all horizontal lines in a display screen equals an image signal input period for inputting a single frame of the image signal; and a delay period from (i) inputting of the $N^{th}$ frame of the image signal for the horizontal lines to (ii) writing of the pixel voltage into the horizontal lines in the $1^{st}$ subframe of the $N^{th}$ frame is shorter than a half of a single frame period of the image signal. It is more preferable that the delay period be shorter than 20% of a single frame period of the image signal.

In the above method, an image displaying operation of plural subframes is performed in such a manner that the period of displaying an image of the $1^{st}$ subframe of the $N^{th}$ frame (N is an integer of not less than 2) overlaps at least (i) a part of the period of displaying the image based on the $2^{nd}$ subframe of the $N^{th}$ frame and (ii) a part of the period of displaying the image based on the nth subframe of the $(N-1)^{th}$ frame. Therefore, it is possible to reduce the required memory size of the frame memory for storing an image signal for the purpose of creating a display signal of each subframe.

Specifically, the image signal needs to be accumulated in a memory (frame memory or the like) until a display signal of a final subframe is generated. If an image displaying operation is performed sequentially for each of the subframes (e.g. performing the image displaying operation for the $1^{st}$ subframe, and then for the $2^{nd}$ subframe), the memory needs to accumulate the entire image signal of a single frame until a display signal of the nth subframe (final subframe) is generated.

On the contrary, in the above configuration, image displaying operations of plural subframes are performed in a parallel manner. Therefore, after a display signal of a final subframe (nth subframe) of an image signal for one horizontal line is generated, an image signal for another horizontal line can be written into a memory region assigned to that one horizontal line. Thus, sharing of the memory region between the horizontal lines is possible.

In a case of sharing a memory region as described above, a required memory size is determined by the number of subframes into which a single frame is divided.

Thus, where N is the number of subframes, the required memory size covers about ((N−1))/N frames, although this may be slightly varied depending on the retrace period. When the number of subframes is 2, the memory size is about ½ of a memory size for accumulating a single frame of an image signal. When the number of subframes is 3, the memory size is about ⅔ of a memory size for accumulating a single frame of an image signal.

Further, by performing image displaying operations of plural subframes in a parallel manner, the period of writing a pixel voltage into all the horizontal lines in the display screen is made equal to an image signal input period for inputting a single frame of the image signal, for each of the subframes. In other words, an input period of an image signal for all the horizontal lines is made equal to a period in each subframe for completing writing of a pixel voltage to all the horizontal lines in a display module. With this, the delay period from (i) inputting of the $N^{th}$ frame of the image signal for the horizontal lines to (ii) writing of the pixel voltage into the horizontal lines in the $1^{st}$ subframe of the $N^{th}$ frame is shorter than a half of a single frame period of the image signal (more preferably, shorter than 20% of a single frame period of the image signal).

Thus, a time lag between inputting of an image signal and displaying of an image is reduced to an insignificant level. In a case of a television receiver or the like, it is possible to prevent displayed image and sound being out of sync with each other, and a circuit or the like for delaying the sound is not necessary. Further, in a case of using the display device as an image display device for a machine such as a personal computer, gaming machine, or the like requiring immediate updating of image displaying in response to an input operation, it is possible to perform image displaying less influenced by a time lag in relation to an operation.

The displaying method of the present invention may comprise the steps of: generating, from the input signal, a display signal of the $1^{st}$ subframe without a use of a frame memory for storing the input image signal; and generating display signals of the $2^{nd}$ to nth subframes by reading out the image signal stored in the frame memory.

With this, the number of times of accessing (writing/reading) to the frame memory is reduced. Therefore, a memory bandwidth of the frame memory can be reduced. As to conversion of transfer frequency, the input image signal is written into a line memory or the like, and is read out so as to achieve a required transfer frequency.

The displaying method of the present invention is preferably such that, for each of the $1^{st}$ to nth subframes, a period from (i) writing of the pixel voltage of one subframe into the horizontal lines of the screen to (ii) writing of the pixel voltage of a next subframe into the horizontal lines is the same.

In this way, a period from (i) an image displaying operation for one subframe to (ii) an image displaying operation for the next subframe through which displaying of that one subframe is replaced is made the same in each subframe. Thus, even if a single frame period is changed due to a change in an input frame frequency, the time ratio of subframe periods in a single frame remains the same. Therefore, in a single frame period, a time integration amount of displayed luminance of each subframe does not change. Thus, a grayscale conversion value can be used for each subframe irrespective of a frame frequency. This allows restraining of the cost needed for means for converting a grayscale on a subframe-by-subframe basis.

Here, depending on the response capability of a display module, there is a case where, for example, periods of subframes are intentionally made unequal for the purpose of improving an effect of reducing video blurring. In such a case, a grayscale conversion value according to an input frame frequency is prepared even if doing so will increase the cost. Therefore, application of the present invention is not limited to a case where subframe periods are the same.

In order to achieve the foregoing object, a drive control device of the present invention for a display device is a drive control device of a display device for displaying an image, in which a single frame of an input image signal is divided into $1^{st}$ to nth subframes (where n is an integer of not less than 2) in a time-divisional manner, the drive control device including: a signal generating section for generating, from the input image signal, a display signal of each of the $1^{st}$ to nth subframes; and a timing control section for generating a control signal for causing a display screen of a display module to perform image displaying using the display signal of each of the $1^{st}$ to nth subframes, wherein the timing control section generates the control signal so that: a period of displaying an image of a $1^{st}$ subframe of an $N^{th}$ frame (N is an integer of not less than 2) overlaps at least (i) a part of a period of displaying an image based on the $2^{nd}$ subframe of the $N^{th}$ frame and (ii) a part of a period of displaying an image based on the nth subframe of an $(N-1)^{th}$ frame; for each of the subframes, a period of writing a pixel voltage into all horizontal lines in the display screen equals an image signal input period for inputting a single frame of the image signal; and a delay period from (i) inputting of the $N^{th}$ frame of the image signal for the horizontal lines to (ii) writing of the pixel voltage into the horizontal lines in the $1^{st}$ subframe of the $N^{th}$ frame is shorter than a half of a single frame period of the image signal. It is more preferable that the timing control section generates the control signal so that the delay period is shorter than 20% of a single frame period of the image signal. Here, the signal generating section is a section for generating a display signal of each of subframes, aiming at reducing video blurring for example.

With this, the signal generating section generates a display signal of each of the $1^{st}$ to nth subframes from an input image signal, and the timing control section generates control signal for causing the display screen of the display module to perform image displaying using the display signal of each of the $1^{st}$ to nth subframes.

Here, the timing control section generates the control signal so that: a period of displaying an image of a $1^{st}$ subframe of an $N^{th}$ frame (N is an integer of not less than 2) overlaps at least (i) a part of a period of displaying an image based on the $2^{nd}$ subframe of the $N^{th}$ frame and (ii) a part of a period of displaying an image based on the nth subframe of an $(N-1)^{th}$ frame; for each of the subframes, a period of writing a pixel voltage into all horizontal lines in the display screen equals an image signal input period for inputting a single frame of the image signal; and a delay period from (i) inputting of the $N^{th}$ frame of the image signal for the horizontal lines to (ii) writing of the pixel voltage into the horizontal lines in the $1^{st}$ subframe of the $N^{th}$ frame is shorter than a half of a single frame period of the image signal. Thus, as is already explained in the description of the displaying method, the memory size of the frame memory for storing an image signal for generating a display signal of a subframe can be reduced, and a time lag between inputting of an image signal and actual displaying of an image is reduced to an insignificant level.

Specifically, the display device of the present invention may be adapted so that, in the memory, a size of an address space used for displaying a single frame of a still image on the screen, based on the image signal corresponding to the single frame, covers 50% or more of the screen but less than the entire screen.

Further, when the frame frequency (vertical frequency) of an input image signal is 60 Hz, an image displaying operation of the $1^{st}$ subframe is performed with respect to all the pixels of the display screen, within 8.3 ms after inputting of the image signal for all the pixels. In this way, a time lag between inputting of the image signal and actual displaying of the image is not a problem, and sufficient video displaying quality is achieved. In this case, it is more preferable that the image displaying operation of the $1^{st}$ subframe be performed with respect to all the pixels of the display screen, within 3.3 ms after inputting of the image signal for all the pixels. This further reduces the time lag between inputting of the image signal and actual displaying of the image is not a problem, and the video displaying quality further improved.

In the drive control device of the present invention for a display device, it is possible that the timing control section generates the control signal so that (i) the pixel voltage according to the display signal of each of the $1^{st}$ to nth subframes is output in a time-divisional manner for one horizontal line at a time, and (ii) a selection signal is output in response to the pixel voltage.

For example, it is assumed that the number of scan signal lines is 100, and a frame is divided into 2 subframes ($1^{st}$ and $2^{nd}$ subframes). In this case, in the above configuration, a voltage according to a display signal of a $1^{st}$ subframe of an $N^{th}$ frame for each pixel along a $1^{st}$ scan signal line is first output from the data signal line drive circuit to each data signal line. Subsequently, a voltage according to a display signal of a $2^{nd}$ subframe of an $(N-1)^{th}$ frame for each pixel along a $51^{st}$ scan signal line is output. Then, a voltage according to a display signal of a $1^{st}$ subframe of an $N^{th}$ frame for each pixel along a $2^{nd}$ scan signal line. In this way, display signal of each subframe is output in a time-divisional manner for one horizontal line at a time.

On the other hand, the scan signal lines are grouped in the vertical direction, and from the scan signal line drive circuit, a selection signal is sequentially output in response to the output of the data signal line drive circuit to each of the scan signal lines in an order of, for example, a $1^{st}$ scan signal line, a $51^{st}$ scan signal line, a $2^{nd}$ scan signal line, and a $52^{nd}$ scan signal line, while successively switching a selected group amongst these groups (in this case the selected group is alternately switched).

In this way, image displaying operations for plural subframes can be performed in a parallel manner with a use of a normal display module whose screen is not divided, as if the screen of the display module is divided into 2 screens. It is not necessary to use a display module whose display screen is divided and which performs displaying on a screen by screen basis.

The drive control device of the present invention for a display device may include: a memory control section for controlling writing/reading of the input image signal to/from a frame memory for storing the input image signal, wherein when the display signal of the nth subframe for one pixel is generated, the memory control section writes an input image signal for another pixel into a region of the frame memory in which region the image signal corresponding to that one pixel is stored.

With this configuration, it is possible to adopt as the frame memory for storing the input image signal a memory whose memory size is small. Alternatively, since there will be redundancy in the memory size, it is possible to add another function, utilizing the free address space of the memory. For example, it is possible to add an overshoot function for improving a response capability for playing a video.

Further, the drive control device of the present invention for a display device may be adapted so that the signal generating section generates the display signal of the $1^{st}$ subframe from the input image signal without a use of the frame memory for storing the input image signal, and a display signal of each of the $2^{nd}$ to nth subframes by reading out the image signal stored in the frame memory.

With this, the number of times of accessing (writing/reading) to the frame memory is reduced, and a memory bandwidth of the frame memory can be reduced, as is already explained in the description of the displaying method.

Further, the drive control device of the present invention for a display device may be adapted so that, for the $1^{st}$ subframe, the timing control section does not change the delay period even if a single frame period of the input image signal varies; and for each of the $2^{nd}$ to nth subframes, the timing control section does not change the delay period if the single frame period of the input image signal varies by less than a reference value, but changes the delay period if the single frame period of the input image signal varies by the reference value or more, the delay period being a period from (i) inputting of the $N^{th}$ frame of the image signal for the horizontal lines to (ii) writing of the pixel voltage into the horizontal lines in the $1^{st}$ subframe of the $N^{th}$ frame.

For example, in a case where the present invention is applied to a tuner section of a television receiver or a display device of a personal computer, the period of one input frame may slightly varies depending on the image signal source (external input device). For example, a total number of lines of one input frame may randomly vary within a range of T−3 to T+3 in relation to a standard total number of lines T. When the variation in one input frame is that level, fine-adjustment of each subframe period according to the total number of lines of each frame input will increase the cost for the control circuit. However, the increase in such a cost can be avoided with the above-described configuration.

A display device of the present invention includes: any one of the above-described drive control devices for a display device; and a display module including a pixel driven by the drive control device. Further, in addition to the configuration, the display device may include: image receiving means for receiving television broadcasting and for inputting, to the drive control device, an image signal representing an image transferred by means of television broadcasting, wherein the display module is a liquid crystal display module, and the display device operates as a liquid crystal television receiver. Further, in addition to the configuration, the display device may be adapted so that the display module is a liquid crystal display module; to the control device, the image signal is input from outside; and the display device operates as a liquid crystal monitor device which displays an image represented by the image signal.

In order to achieve the foregoing object, a scan signal line drive circuit of the present invention is a scan signal line drive circuit for driving plural scan signal lines arranged in a display section of a display module, wherein: during a $1^{st}$ driving mode, a scan signal line in a stage is turned to an active level at a $g^{th}$ clock (where g is an integer of not less than 2) counted from a clock at which a scan signal line in a previous stage is turned to the active level.

In order to achieve the foregoing object, a scan signal line driving method of the present invention is a method for driving plural scan signal lines arranged in a display section of a display module, wherein: during a $1^{st}$ driving mode, a scan signal line in a stage is turned to an active level at a $g^{th}$ clock (where g is an integer of not less than 2) counted from a clock at which a scan signal line in a previous stage is turned to the active level.

As mentioned above, to perform image displaying operations of plural subframes in a parallel manner with a use of a normal display whose screen is not divided, the scan signal lines are grouped in the vertical direction in the scan signal line drive circuit, and a selection signal is output to the scan signal lines, while successively switching a selected group amongst these groups (in this case the selected group is alternately switched).

In this case (see the above-described example for the following explanation), the $1^{st}$ scan signal line (scan signal line in a stage) turns to the active level in response to a clock. Then, in response to the next clock, the $51^{st}$ scan signal line in another group turns to the active level. Then, the $2^{nd}$ scan signal line (scan signal line of the next stage) turns to the active level in response to the next clock. Thus, the $2^{nd}$ scan signal line turns to the active level in response to the $2^{nd}$ clock counted from the clock at which the $1^{st}$ scan signal line turns to the active level. As described, between the scan signal line in that one stage and the scan signal line in the next stage, it is necessary to skip the clocks according to the number of the groups (the number of the subframes).

In the above-described configuration, the $1^{st}$ driving mode is adopted. Therefore, it is easy to realize such driving that the $2^{nd}$ scan signal line turns to the active level in response to the $2^{nd}$ clock counted from the clock at which the $1^{st}$ scan signal line turns to the active level.

Further, a scan signal line drive circuit of the present invention may be adapted so that, during the $1^{st}$ driving mode, each of the scan signal lines is turned to an inactive level at a clock next to a clock at which the scan signal line is turned to the active level.

Further, the scan signal line driving method of the present invention may be adapted so that, during the $1^{st}$ driving mode, each of the scan signal lines is turned to an inactive level at a clock next to a clock at which the scan signal line is turned to the active level.

In this way, each scan signal line is selected and turned to the active level only between a clock and another clock. Thus, it is possible to successively select and drive each of the scan signal lines at a clock cycle.

Further, the scan signal line drive circuit of the present invention may include: plural semiconductor chips which are cascade-connected, wherein during the $1^{st}$ driving mode, a semiconductor chip outputs to another semiconductor chip in a subsequent stage a start pulse at the $g^{th}$ clock counted from a clock at which a final scan signal line amongst the scan signal lines driven by that one semiconductor chip is turned to the active level.

In recent years, plural semiconductor chips are cascade-connected in a scan signal line drive circuit. Even in such a case, by having one semiconductor chip output a start pulse to another semiconductor chip in the next stage at $g^{th}$ clock counted from a clock at which a final scan signal line of that one semiconductor chip is turned to the active level, a first scan signal line of the semiconductor chip in the next stage is turned to the active level at the $g^{th}$ clock. Thus, the $1^{st}$ driving mode is realized without a problem.

Further, the scan signal line drive circuit of the present invention may be adapted so that, during a $2^{nd}$ driving mode, a scan signal line in one stage is turned to the active level at a clock next to a clock at which a scan signal line in a previous stage is turned to the active level, wherein switching between the $1^{st}$ and $2^{nd}$ driving modes is possible.

The scan signal line driving method of the present invention may be adapted so that, during a $2^{nd}$ driving mode, a scan signal line in one stage is turned to the active level at a clock next to a clock at which a scan signal line in a previous stage is turned to the active level; and switching between the driving modes is possible.

Since switching of a driving mode between the $1^{st}$ and $2^{nd}$ driving mode is possible, displaying in which a frame is not divided into subframes is also supported.

Further, the scan signal line drive circuit and the scan signal line driving method of the present invention may be adapted so that g is variable.

With this, g is determined according to the number of subframes. Thus, when the number of subframes is 2, g=2. When the number of the subframes is 3, g=3. Accordingly, by allowing a change in the value of g, displaying with different numbers of subframes is possible.

The value of g may be changed by a user with a use of a switch, in accordance with an image to be displayed. Alternatively, if the display device is such that the number of subframes are set according to an image to be displayed, the display device may discriminate the type of the image signal, specify the number of subframes into which an input image signal is divided, and change the value of g according to the result of specifying the number.

A display module of the present invention includes any one of the scan signal line drive circuit.

As described, a displaying method of the present invention is a method of displaying an image in which a single frame of an input image signal is divided into $1^{st}$ to nth subframes (where n is an integer of not less than 2) in a time-divisional manner, wherein: a period of displaying an image of a $1^{st}$ subframe of an $N^{th}$ frame (N is an integer of not less than 2) overlaps at least (i) a part of a period of displaying an image based on the $2^{nd}$ subframe of the $N^{th}$ frame and (ii) a part of a period of displaying an image based on the nth subframe of an $(N-1)^{th}$ frame, and for each of the subframes, a period of writing a pixel voltage into all horizontal lines in a display screen equals an image signal input period for inputting a single frame of the image signal; and a delay period from (i) inputting of the $N^{th}$ frame of the image signal for the horizontal lines to (ii) writing of the pixel voltage into the horizontal lines in the $1^{st}$ subframe of the $N^{th}$ frame is shorter than a half of a single frame period of the image signal. It is more preferable that the delay period be shorter than 20% of a single frame period of the image signal.

Further, a drive control device of the present invention for a display device is a drive control device of a display device for displaying an image, in which a single frame of an input image signal is divided into $1^{st}$ to nth subframes (where n is an integer of not less than 2) in a time-divisional manner, the drive control device including: a signal generating section for generating, from the input image signal, a display signal of each of the $1^{st}$ to nth subframes; and a timing control section for generating a control signal for causing a display screen of a display module to perform image displaying using the display signal of each of the $1^{st}$ to nth subframes, wherein the timing control section generates the control signal so that: a period of displaying an image of a $1^{st}$ subframe of an $N^{th}$ frame (N is an integer of not less than 2) overlaps at least (i) a part of a period of displaying an image based on the $2^{nd}$ subframe of the $N^{th}$ frame and (ii) a part of a period of displaying an image based on the nth subframe of an $(N-1)^{th}$ frame; for each of the subframes, a period of writing a pixel voltage into all horizontal lines in the display screen equals an image signal input period for inputting a single frame of the image signal; and a delay period from (i) inputting of the $N^{th}$ frame of the image signal for the horizontal lines to (ii) writing of the pixel voltage into the horizontal lines in the $1^{st}$ subframe of the $N^{th}$ frame is shorter than a half of a single frame period of the image signal. It is more preferable that the timing control section generates the control signal so that the delay period is shorter than 20% of a single frame period of the image signal.

Thus, it is possible to provide a displaying method and a drive control device or the like for a display device which causes less time lag between inputting of an image signal and displaying of an image even if a frame is divided into subframes in time of driving, and which restrains the cost for a frame memory for storing an input image signal.

BRIEF DESCRIPTION OF DRAWINGS

FIG. 1 shows an embodiment of the present invention, and is a block diagram showing a configuration of a main part of an image display device.

FIG. 4 is a timing chart showing respective operations of each section of the control device and a source driver section and a gate driver section of a display module, while a displaying operation for a $1^{st}$ subframe of an $N^{th}$ frame and a displaying operation of a $2^{nd}$ subframe in an $(N-1)^{th}$ frame are performed in a parallel manner.

REFERENCE NUMERALS

Figure 2:
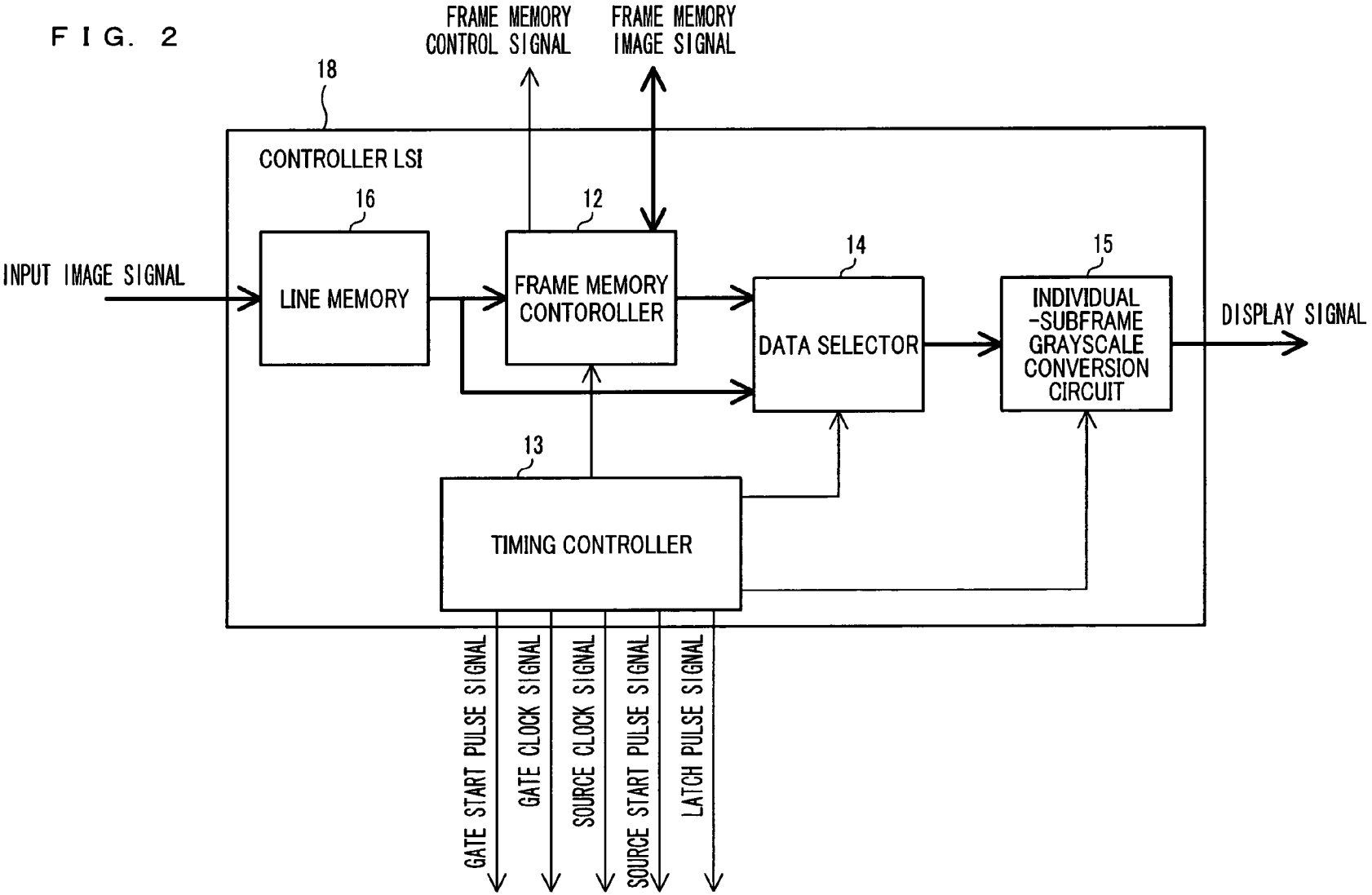
FIG. 2 is a circuit diagram showing an example of configuration of a controller LSI provided in the image display device.

1 Image Display Device (Display Device)
2 Pixel Array
10 Control Device (Control Drive Device)
11 Frame Memory
12 Memory Controller (Memory Control Section)
13 Timing Controller (Timing Control Section)
15 Individual-Subframe Grayscale Conversion Block (Signal Generating Section)
16 Line Memory
19 Display Module

BEST MODE FOR CARRYING OUT THE INVENTION

An embodiment of the present invention is described hereinbelow, with reference to FIG. 1.

A display device of the present embodiment (hereinafter, the present image display device) is a display device such that a time lag between inputting of an image signal and displaying of an image is less even in a case of adopting a driving method in which a frame is divided into subframes. Further, the present image display device restrains costs of a frame memory for storing an input image signal.

For example, the present image display device is suitably used as a display monitor to be connected to a television receiver, or a personal computer. Examples of television broadcasting the television receiver is able to receive are: terrestrial television broadcasting; broadcasting via an artificial satellite such as BS (Broadcasting Satellite) digital broadcasting, Cs (Communication Satellite) digital broadcasting; cable television broadcasting; or the like.

As shown in FIG. 1, the present image display device includes a display module 19 and a control device (drive control device) 10. The display module 19 may be an EL display module, liquid crystal display module, or a hold-type display module, although the present image display device adopts a liquid crystal display module.

The display module 19 includes: a pixel array 20 having plural pixels arranged in a matrix manner. Each of the pixels is arranged, along with an active element, at an intersection of one of source signal lines (data signal lines) SL1 to SLn and one of gate signal lines (scan signal lines) GL1 to GLm, each of which lines is provided in the pixel array 20. To each pixel (precisely, each pixel electrode), the active element (a TFT in the figure) writes a voltage applied to the corresponding source signal line SL, only while the corresponding gate signal line GL is selected.

Nearby the pixel array 20, a source driver section (data signal line drive circuit) 21 for driving the source signal lines SL1 to SLn and gate driver sections (scan signal line drive circuit) 23 for driving the gate signal lines GL1 to GLm are provided.

The gate driver section 23 outputs to the gate signal lines GL1 to GLm a signal such as a voltage signal indicating whether or not a gate signal line GL is selected. Meanwhile, the gate driver section 23 changes which one of gate signal lines GL a signal indicating the selected period is for, on the basis of a timing signal such as: a gate clock signal GCK which is a control signal from the control device 10; a gate start pulse signal GSP; or the like. Thus, each of the gate signal lines GL1 to GLm is selectively driven at a predetermined timing.

The gate driver sections 23 of the present image display device do not successively turn on, at a timing of inputting gate clock GCK. Instead, it adopts a clock-skipping mode ($1^{st}$ driving mode) during which a gate signal line GL of one stage is turned to an active level in response to a $g^{th}$ gate clock (where g is an integer of 2 or more) counted from a gate clock at which a gate signal line GL of the previous stage is turned to the active level. The clock-skipping mode is described later.

On the other hand, the source driver section 21 drives the source signal lines SL1 to SLn, by applying, to the source signal lines SL1 to SLn, a voltage indicated by a displaying signal. Here, the source driver section 21 extracts, through sampling or the like performed at a predetermined timing, a displaying signal for pixels which is input in a time-divisional manner by the control device 10. Then, to each pixel along a gate signal line GL selected by the gate driver section 23, the source driver section 21 outputs an output signal according to the display signal via the source signal lines SL1 to SLn.

Note that the source driver section 21 determines a sampling timing or an output timing for an output signal, based on a timing signal such as: a source clock signal SCK, a source start pulse signal SSP, or a latch pulse signal LS each of which signal is a control signal from the control device 10

Each of the pixels in the pixel array 20 determines its brightness, by adjusting its luminance or transmissivity at the time of emitting light according to an output signal given to the associated one of the source signal lines SL1 to SLn, while the associated gate signal line GL is selected.

Further, in the present image display device, each of the source driver section 21 and the gate driver section 23 includes plural semiconductor chips which are cascade-connected.

In the source driver section 21, four source drivers ($1^{st}$ to $4^{th}$ source drivers) each of which is a single chip are cascade-connected. Where n is the number of the source signal lines SL of the pixel array 20, each source driver drives n/4 of the source signal lines SL.

A display signal and a source start pulse signal SSP from the control device 10 are input to the $1^{st}$ source driver, and are successively sent to the $2^{nd}$ source driver, the 3rd source driver, and the $4^{th}$ source driver. A source clock signal SCK and a latch pulse signal LS from the control device 10 are input, in a parallel-manner, to the $1^{st}$ to $4^{th}$ signal line drivers.

In the gate driver section 23, three gate drivers ($1^{st}$ to 3rd gate drivers) each of which is a single chip are cascade-connected. Where m is the number of the gate signal lines GL of the pixel array 20, each of the gate drivers drives m/3 of the gate signal lines.

A gate start pulse signal GSP from the control device 10 is input to the $1^{st}$ gate driver, and is successively sent to the $2^{nd}$ gate driver, and to the $3^{rd}$ gate driver. Further, a gate clock signal GCK from the control device 10 is input, in a parallel-manner, to the $1^{st}$ to the $3^{rd}$ gate drivers.

The control device 10 is for controlling a display operation of the display module 19. With an externally input image signal (input image signal) and a control signal (input control signal), the control device 10 outputs (i) a display signal for driving the display module 19 and (ii) a control signal such as the foregoing source clock signal SCK, source start pulse signal SSP, or the like.

Since the present image display device adopts a subframe-displaying in which a frame is divided into subframes, the control device 10 generates display signals to be supplied to the display module 19 as display signals of plural subframes. Here, it is supposed that: the number of subframes is 2; one of the subframes which is earlier in terms of time is a $1^{st}$ subframe; and one of the subframes which is later in terms of time is a $2^{nd}$ subframe.

Further, in a case of the present image display device, an image displaying period of a $1^{st}$ subframe of an $N^{th}$ frame is partially overlapped with an image displaying period of a $2^{nd}$ subframe of the $N^{th}$ frame and an image displaying period of a $2^{nd}$ subframe of an $(N-1)^{th}$ frame. For each of the subframes, a period of writing a pixel voltage into all horizontal lines in a display screen equals an image signal input period for inputting a single frame of the image signal. A delay period from (i) inputting of the $N^{th}$ frame of the image signal for the horizontal lines to (ii) writing of the pixel voltage into the horizontal lines in the $1^{st}$ subframe of the $N^{th}$ frame is shorter than a half of a single frame period of the image signal. Here, as a preferable configuration, the delay period is made shorter than 20% of the period of the single frame of the input image signal. The control device 10 generates and outputs a control signal so that the above-described image displaying operation is performed in the display module 19.

In a case where the number of the subframes are 4, although it depends on the start timing of each subframe, the respective image displaying periods of the $1^{st}$ subframe of the $N^{th}$ frame, the $2^{nd}$ subframe of the $N^{th}$ frame; the $3^{rd}$ subframe of the $N^{th}$ frame; a $3^{rd}$ subframe of an $(N-1)^{th}$ frame; and a $4^{th}$ subframe (final subframe) of an $(N-1)^{th}$ frame are partially overlapped.

If the present image display device is a television receiver, an example of an image signal source for transferring input image signals and input control signals to the above-described control device 10 is a tuner (image receiving means) which receives television broadcasting, and generates an image signal representing an image having transferred by means of the television broadcasting. Further, if the present image display device is a display monitor, an example of the image signal source is a personal computer, or the like.

Next, the following describes in detail the configuration and operation of the control device 10. As shown in FIG. 1, the control device 10 of the present image display device includes: a frame memory 11; and a controller LSI 18. The controller LSI 18 is provided with: a line memory 16; a memory controller 12; a timing controller 13; a data selector 14; and an individual-subframe grayscale conversion circuit 15, as shown in FIG. 2.

An image signal (input image signal) transmitted from an image signal source is written into the line memory 16 provided at an input stage of the controller LSI 18 for each line (each horizontal line). The image signal written in is read out at a double of the transfer frequency, and is transferred to the memory controller 12 and data selector 14, for a subsequent time-division transfer process.

The memory controller (memory control) 12 controls writing/reading of the image signal into/from the frame memory 11. While the memory controller 12 writes the image signal read out from the line memory 16 into the frame memory 11 for one horizontal line at a time, the memory controller 12 reads out in a time-divisional manner an image signal from the frame memory 11, and transfers the image signal read out to the data selector 14.

When outputting an image signal corresponding to the $1^{st}$ subframe, the data selector 14 selects an image signal transferred from the line memory 16. When outputting an image signal corresponding to the $2^{nd}$ subframe, the data selector 14 selects an image signal read out from the frame memory 11.

The individual-subframe grayscale conversion circuit 15 is a signal generating section of the present invention. For the purpose of reducing the video blurring, the individual-subframe grayscale conversion circuit 15 generates a display signal of each of plural subframes from the input image signal. Then, the individual-subframe grayscale conversion circuit 15 outputs the display signal to the display module 19.

The individual-subframe grayscale conversion circuit 15 uses an LUT (Lookup Table) or the like to convert a grayscale value of an image signal according to an image signal transferred from the data selector 14. The number of LUTs provided are dependent on the number of the subframes. Here, two LUTs (one for a preceding subframe and another for a subsequent subframe) are provided. Processing of subframes performed in the individual-subframe grayscale conversion circuit 15 is described later in detail.

The timing controller 13 controls: the operation of reading out an image signal from the line memory 16; the operation of the memory controller 12 accessing to the frame memory 11; and operation timings of the data selector 14 and the individual-subframe grayscale conversion circuit 15; and the like. The timing controller 13 serves as a timing control section of the present invention, and controls outputting of the display signal generated by the individual-subframe grayscale conversion circuit 15 and outputting of the above-described control signals (clock signal SCK, start pulse signal SSP, latch pulse signal LS, gate clock signal GCK, gate start pulse signal GSP) which are to be supplied to the display module 19.

Figure 3:
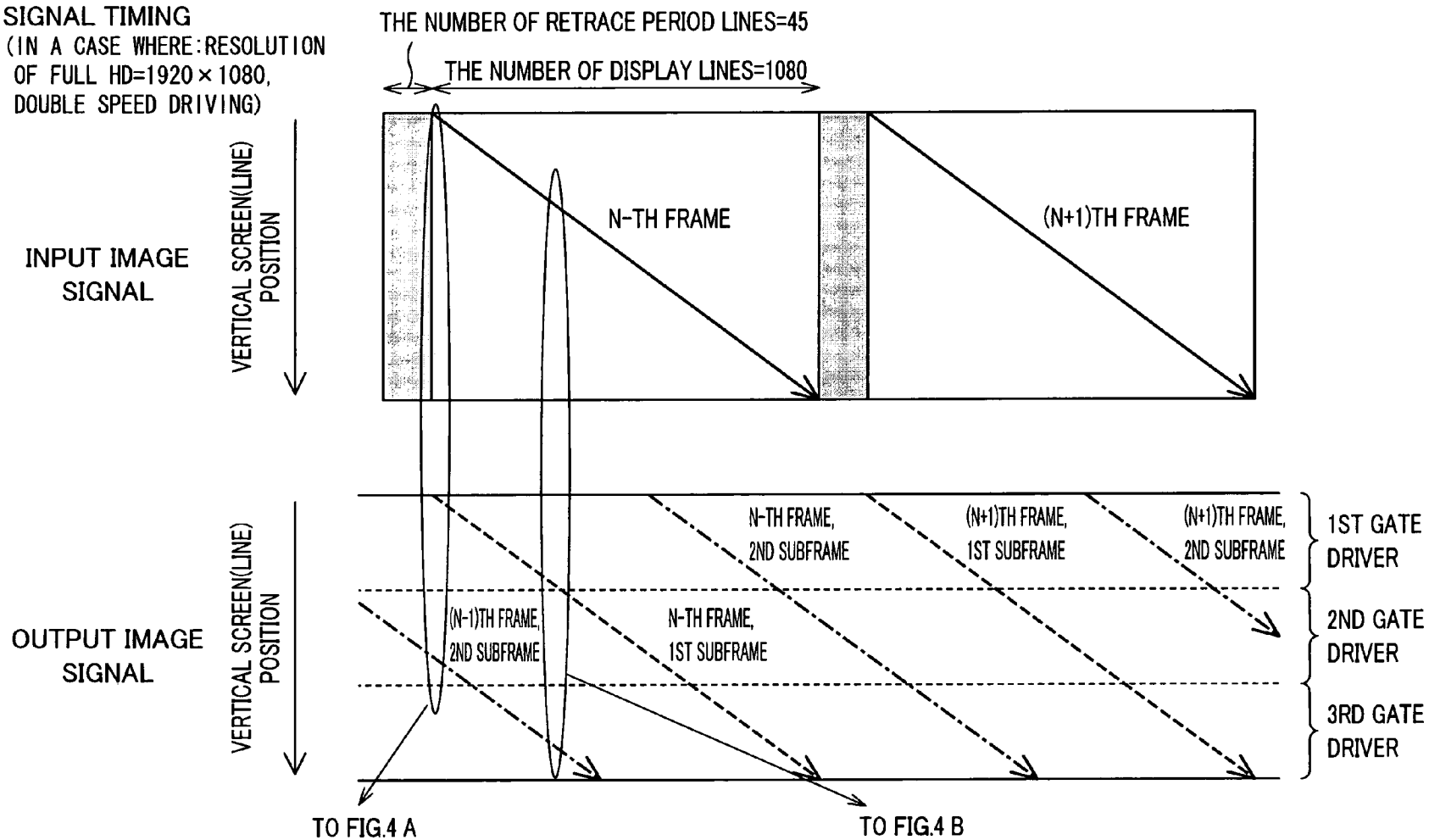
FIG. 3 is an explanatory diagram showing a relation between an input image signal and an output display signal which is output after a control device provided in the image display device processes the input image signal.

FIG. 3 shows a time-based relation between (i) the image signal input to the control device 10 and (ii) the display signal output from the control device 10. Here, it is assumed that one frame of the input image signal corresponds to 1080 display lines (horizontal lines) and 45 vertical retrace lines.

In the present image display device, an image of an $N^{th}$ frame is displayed through displaying of an image of the $1^{st}$ subframe and an image of the $2^{nd}$ subframe. However, as shown in FIG. 3, the $1^{st}$ subframe of the $N^{th}$ frame is displayed along with a trailing portion of a $2^{nd}$ subframe of an $(N-1)^{th}$ frame (the previous frame). The trailing portion of the $1^{st}$ subframe of the $N^{th}$ frame is displayed along with a leading portion of the $2^{nd}$ subframe of the $N^{th}$ frame.

In this case, a vertical display operation period of each subframe is the same as a vertical input period (1 frame period) of one frame of the input image signal. Here, an operation of displaying the image of the $1^{st}$ subframe is performed with respect to all the pixels of the display screen so as to avoid falling behind the inputting of the image signal for each pixel as much as possible.

FIG. 4 shows operation timings of each section of the control device 10 and the source driver section 21 and the gate driver section 23 in the display module 19, at a time of performing displaying operation for the $1^{st}$ subframe of the $N^{th}$ frame along with the displaying operation for the $2^{nd}$ subframe of the $(N-1)^{th}$ frame.

The controller LSI 18 in the control device 10 outputs a source start pulse signal SSP to the source driver section 21 in the display module 19, thereby initializing shift registers inside the source driver section 21. Then, the controller LSI 18 outputs a display signal for a single line (for a single horizontal line: i.e., a single gate signal line GL) in synchronization with the source clock signal SCK. The display signal for one line having been output is successively transferred to and retained in the shift registers cascade-connected in the $1^{st}$ to $4^{th}$ source drivers.

Next, when a latch pulse signal is output from the controller LSI 18, respective grayscale values of the shift registers in the source drivers are converted into pixel voltages, and the pixel voltages are supplied through the source signal lines SL.

Through the above-described operation, when an image signal of the $1^{st}$ line (hereinafter, $1^{st}$ line image signal) of the $N^{th}$ frame is input to the controller LSI 18, a pixel voltage according to the display signal for a pixel corresponding to the $1^{st}$ line of the $1^{st}$ subframe of the $N^{th}$ frame is output from each of the $1^{st}$ to the $4^{th}$ source drivers. In the present display device, the pixel voltages according to the display signals for the pixels corresponding to the $1^{st}$ line of the $1^{st}$ subframe of the $N^{th}$ frame are output from the $1^{st}$ to $4^{th}$ source drivers in response to a $2^{nd}$ latch pulse counted from completing of inputting of the $1^{st}$ line image signal of the $N^{th}$ frame.

Immediately before this, when the controller LSI 18 outputs the gate clock signal GCK along with the gate start pulse signal GSP, the $1^{st}$ gate signal line GL1 which is connected to the $1^{st}$ gate driver and which corresponds to the $1^{st}$ line of the pixel array 20 is turned to the active state, and a TFT of each pixel along the $1^{st}$ gate signal line GL 1 is turned on. Thus, the pixel voltages output via the source signal lines SL are applied to the pixels, updating the transmissivity of the liquid crystal. In this way, image display scanning of the $1^{st}$ line is performed.

In response to the next gate clock GCK from the controller LSI 18, the $1^{st}$ gate driver is turned to the inactive state. Meanwhile, at this timing, a $564^{th}$ gate signal line GL 564 (corresponding to a $564^{th}$ line connected to the $2^{nd}$ gate driver) is turned to the active state, and pixel voltages for pixels along the $564^{th}$ line of the $2^{nd}$ subframe of the $(N-1)^{th}$ frame are output from the source drivers.

Further, in response to the next gate clock signal, the $564^{th}$ gate signal line GL564 connected to the $2^{nd}$ gate driver is turned to the inactive state. Further, at this timing, the $2^{nd}$ gate signal line GL 2 (corresponding to the $2^{nd}$ line of the $1^{st}$ gate driver) is turned to the active state, and the pixel voltages for the pixels corresponding to the $2^{nd}$ line of the $1^{st}$ subframe of the $N^{th}$ frame are output from the source driver.

In the similar manner, the pixel voltages are successively written into the gate signal lines GL selected in an order of a $565^{th}$ line, a $3^{rd}$ line, a $566^{th}$ line, a $4^{th}$ line, and so on. Thus, for an input image of 60 Hz in frame frequency, display scanning in which the $1^{st}$ and $2^{nd}$ subframes are generated is performed at a frame frequency of 120 Hz (double speed).

As described, in the present image display device, an image displaying period of the $1^{st}$ subframe of the $N^{th}$ frame (N is an integer of 2 or more) overlaps at least (i) a portion of an image displaying period of the $2^{nd}$ subframe of the $N^{th}$ frame and (ii) a portion of an image displaying period of an $n^{th}$ subframe (final subframe) of the $(N-1)^{th}$ frame. Thus, it is possible to reduce the required memory size of the frame memory 11 for storing an image signal to be used in generating the display signal of each subframe.

More specifically, it is necessary to store an image signal in the frame memory 11 until the display signal of its final subframe is generated. For example, when image displaying operations of subframes are successively performed in a case where the number of the subframes is 2, it is necessary that the frame memory 11 store therein all the image signals corresponding to one frame until a display signal of a $2^{nd}$ subframe (final subframe) is created: e.g., an image displaying operation of a $2^{nd}$ subframe is performed after an image displaying operation of a $1^{st}$ subframe.

On the other hand, the following is possible by performing in a parallel manner image displaying operations of plural subframes as is done in the above-described configuration. Namely, after a display signal of a $2^{nd}$ subframe (final subframe) of an image signal for one horizontal line is generated, an image signal for another horizontal line can overwrite the image signal in a memory region assigned to that one horizontal line. This allows sharing of a memory region amongst the horizontal lines.

This is described more specifically with reference to FIG. 4. In the present image display device, the $1^{st}$ line image signal of the $N^{th}$ frame is input to the line memory 16. Then, the $1^{st}$ line image signal is read out from the line memory 16 at the double speed and output to the display module 19, via the individual-subframe grayscale conversion circuit 15, for performing displaying an image of the $1^{st}$ subframe. Meanwhile, the $1^{st}$ line image signal is written into the frame memory 11. This is for displaying an image of the $2^{nd}$ subframe, and the $1^{st}$ line image signal needs to be retained in the frame memory 11 until an image of a $1^{st}$ line of the $2^{nd}$ subframe of the $N^{th}$ frame is displayed.

On the other hand, an image signal of the $563^{rd}$ line of the $(N-1)^{th}$ frame has been read out from the frame memory 11, prior to the writing of the $1^{st}$ line image signal of the $N^{th}$ frame. However, this image signal of the $563^{rd}$ line of the $(N-1)^{th}$ frame is no longer needed after it is read out for generating a display signal of the $2^{nd}$ subframe of the $(N-1)^{th}$ frame. Accordingly, the $1^{st}$ line image signal of the $N^{th}$ frame can be written into the address where the $563^{rd}$ line image signal of the $(N-1)^{th}$ frame is written. Similarly, the image signal of the $2^{nd}$ line of the $N^{th}$ frame can be written into the address where an image signal of the $564^{th}$ line of the $(N-1)^{th}$ frame is written in.

Figure 5:
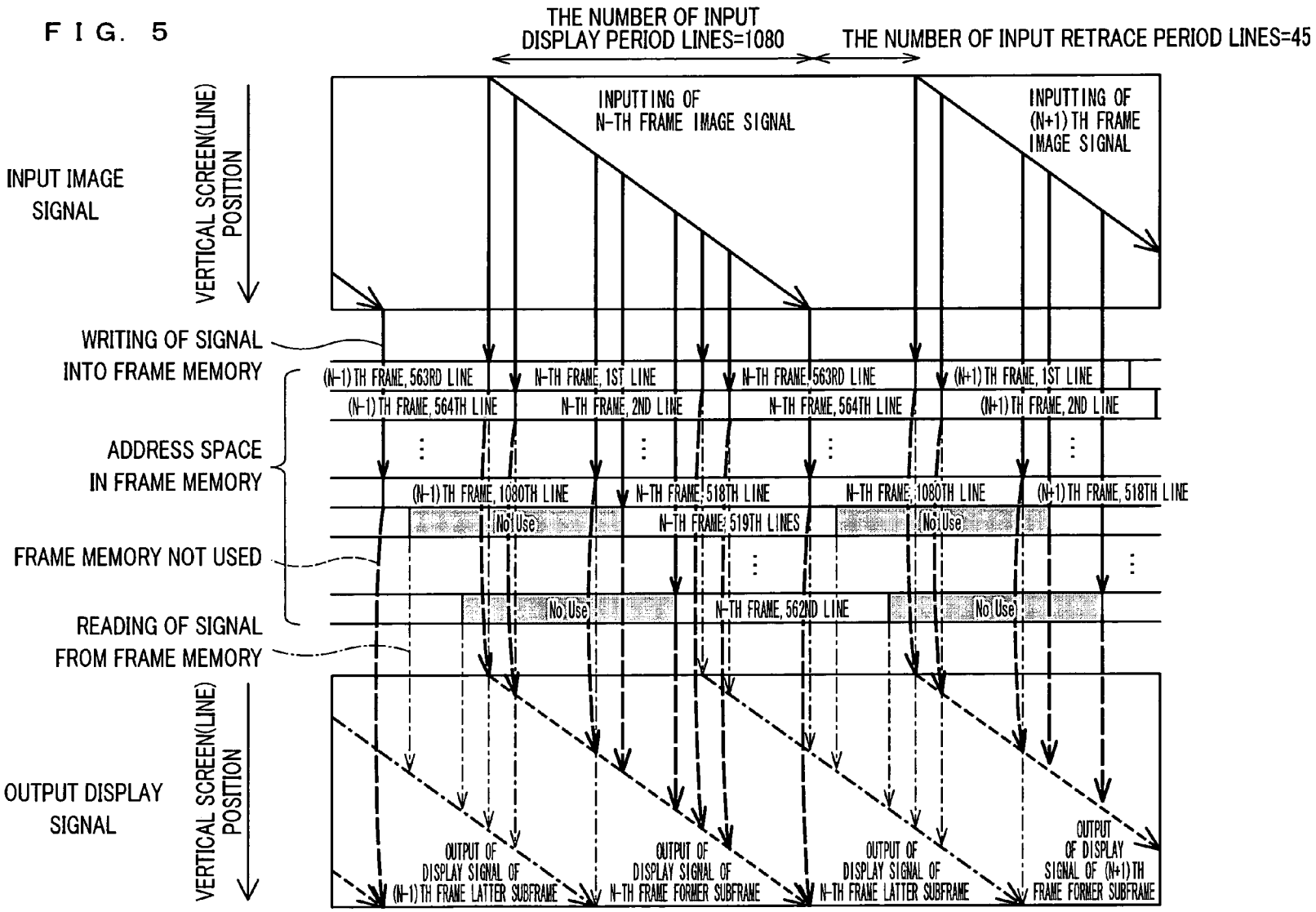
FIG. 5 is an explanatory diagram showing the respective timings of the input image signal and the display signal output, and showing writing/reading of a signal into/from a frame memory.

FIG. 5 shows respective timings of an input image signal and an output display signal, and shows operations of writing/reading an image signal into/from the frame memory 11. Each of the slanted arrows at the top of the figure represents an input image signal, and each of the slanted arrows at the bottom of the figure represents an output display signal of a $1^{st}$ or $2^{nd}$ subframes. Further, the belt-like figures in the middle shows used regions of the frame memory 11. For example, it is apparent from the figure that a signal of the $1^{st}$ line of the $N^{th}$ frame and a signal of the $563^{rd}$ line of the $N^{th}$ frame are successively written into the region where the signal of the $563^{rd}$ line of the $(N-1)^{th}$ frame is retained.

Each of the dotted arrows extended from the input image signal to the frame memory 11 shows writing in the image signal into the frame memory 11. Each of the dot-dashed arrows extended from the frame memory 11 to the output display signal of the $2^{nd}$ subframe shows reading of the input image signal from the frame memory 11. Further, a thin arrow extended from the input image signal to the output display signal of the $1^{st}$ subframe shows a flow of signal, in which flow the signal does not flow into the frame memory 11.

In the present image display device, the period lengths of the $1^{st}$ and $2^{nd}$ subframes are the same. More specifically, for each of the $1^{st}$ and $2^{nd}$ subframes, a period from (i) writing of a pixel voltage of one subframe into all the horizontal lines to (ii) writing of a pixel voltage of the next subframe is the same. Therefore, a delay of the start of performing displaying for the $1^{st}$ line of the $2^{nd}$ subframe from the start of performing displaying for the $1^{st}$ line of the $1^{st}$ subframe is: (1080+45)/2=562.5 lines.

In this case, of the frame memory for storing an image signal, regions assigned to the $1^{st}$ to the $518^{th}$ lines are shared with the $563^{rd}$ to the $1080^{th}$ lines as shown in FIG. 5, and regions for 562 lines are needed in the frame memory. In short, supposing that the period lengths of preceding and subsequent subframes are the same, the memory needs to have a size for (the number of input display period lines+the number of input retrace period lines)/2, which is about 0.5 frame.

As described, the memory controller 12 is such that, once a display signal of the final subframe of one line is generated, an image signal of another line is written in a region of the frame memory 11 where the image signal of that one line is stored.

Here, as described, the size of the memory is determined according to the number of subframes. Although the size slightly varies depending on the retrace period length, the memory needs to have a size of (N−1)/N, where N is the number of the subframes. Thus, when the number of subframes is 2, the memory needs to have a size for ½ of one frame. When the number of subframes is 3, the memory needs to have a size for ⅔ of one frame.

Further, the image displaying operation of the $1^{st}$ subframe is performed with respect to all the pixels of the display screen so as to avoid falling behind the inputting of the input image signal for pixels as much as possible. Thus, displaying of an image represented by an image signal is possible without waiting for one frame period from inputting of the image signal. This reduces a time lag, between inputting of an image signal and actual displaying of an image, to an ignorable level. Therefore, in a television receiver or the like, sound and displayed image are prevented from being out of sync. Thus, there is no need for a circuit or the like for causing the sound to delay. Further, when the present invention is applied to an image display device of a machine such as a personal computer or a gaming machine which requires immediate updating of displayed image in response to an input operation, it is possible to perform image displaying with a less time lag in relation to an operation.

Thus, after an image signal for each pixel is input, the image displaying operation of the $1^{st}$ subframe is performed with respect to all the pixels of the display screen for a period shorter (preferably 20% shorter) than a half of the frame period of the input image signal. This reduces the time lag to an ignorable level.

Further, in the present image display device, while the display signal of the $2^{nd}$ subframe is generated from the image signal stored in the frame memory 11, the display signal of the $1^{st}$ subframe is generated from the image signal which has been stored in the line memory 16. As such, the display signal of the $1^{st}$ subframe is generated without a need of accessing to the frame memory 11. Therefore, the frame memory 11 is less frequently accessed for writing/reading data. This allows reduction of the memory bandwidth of the frame memory 11.

Figure 8:
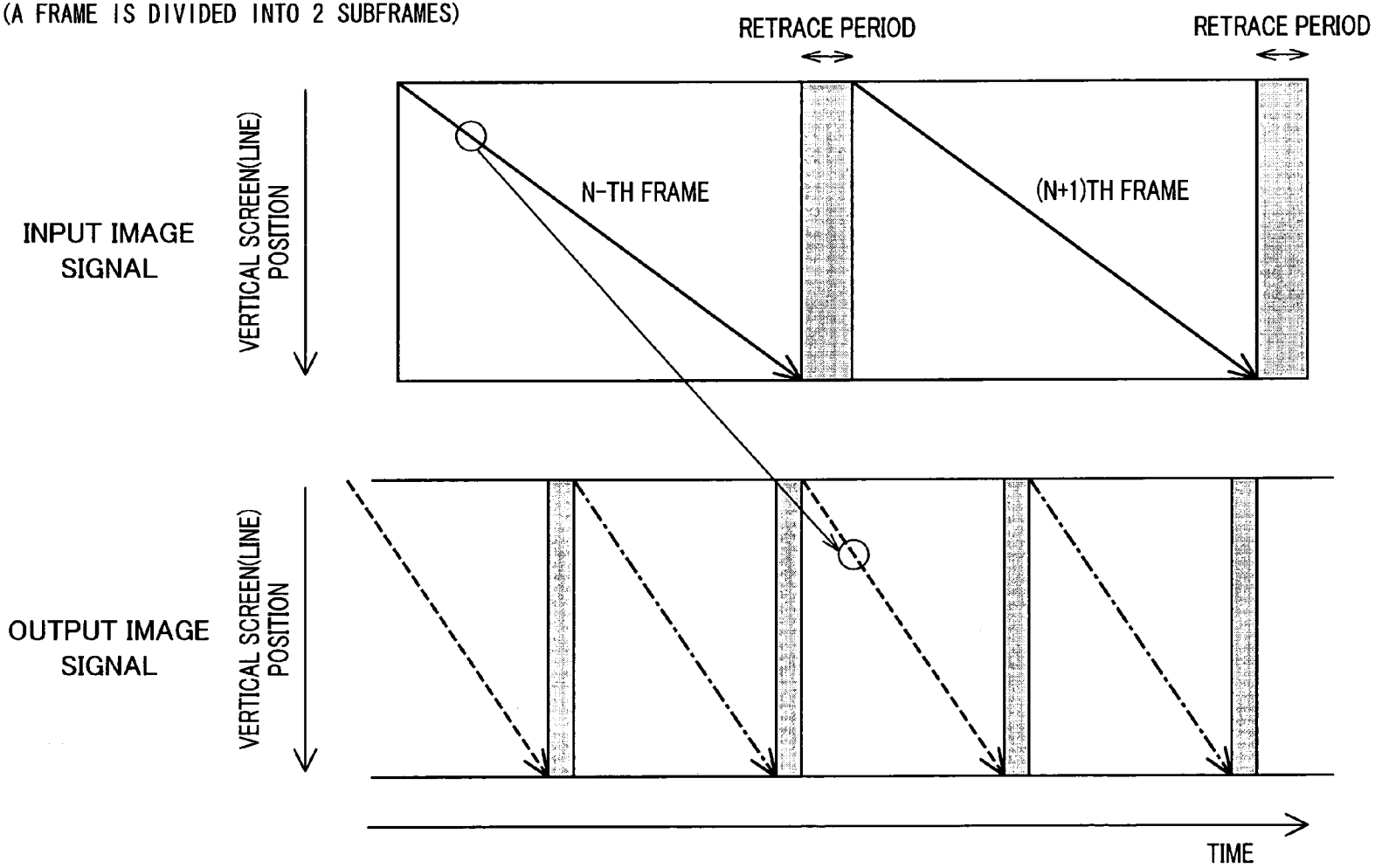
FIG. 8 is an example of a conventional configuration, and is an explanatory diagram showing a relation between an input image signal and an output display signal output by processing the input image signal.

Here, it is only needed to perform writing of an input of a single screen into the frame memory 11, along with reading out of an output of a single screen from the frame memory. Therefore, the transfer frequency (dot-clock frequency)=F (Hz). Where the number of data bits per pixel is D, the required memory bandwidth is FD+FD=2FD (bps). Therefore, it is possible to significantly reduce the memory bandwidth as compared with a conventional driving method (5FD) shown in FIG. 8.

The present image display device supports two input frame frequencies: 60 Hz and 50 Hz. The control device 10 performs control so that a period from (i) inputting of image signals to the horizontal lines to (ii) a displaying operation of the $1^{st}$ subframe is changed according to a change in the input frame frequency (i.e., a change in a single frame period) so that the respective period lengths of the $1^{st}$ and $2^{nd}$ subframes are the same.

Thus, even if a single frame period is changed due to a change in an input frame frequency, the time ratio of subframe periods in a single frame remains the same. Therefore, in a single frame period, a time integration amount of displayed luminance of each subframe does not change. Thus, a grayscale conversion value can be used for each subframe irrespective of a frame frequency. This allows restraining of the cost needed for means for converting a grayscale.

Here, depending on the response capability of a display module, there is a case where periods of subframes are made unequal for the purpose of improving an effect of reducing video blurring. In such a case, a grayscale conversion value according to an input frame frequency is prepared even if doing so will increase the cost. Therefore, application of the present invention is not limited to a case where subframe periods are the same.

Further, the period of one input frame may slightly varies depending on an external input device for the present image display device such as a tuner section of a television receiver or a personal computer. For example, a total number of lines of a single input frame may randomly vary within a range of T−3 to T+3 in relation to a standard total number of lines T. When the variation in one input frame is that level, fine-adjustment of the length of each subframe period according to the total number of lines of each frame input will increase the cost for the control circuit. Therefore, in such a case, a period from (i) inputting of an image signal for horizontal lines to (ii) performing of a display operation of a $2^{nd}$ subframe with respect to the horizontal lines is determined based on the standard total number of lines T, and no change is made in the period.

As reference values of the total number of lines in a single input frame, the control device 10 is provided with T1 for 60 Hz and T2 for 50 Hz.

The following describes the gate driver section 23 which allows the driving.

The above-described gate driver section 23 adopts a clock-skipping mode in which a $2^{nd}$ gate signal line GL2 of one stage is turned to the active level at a $g^{th}$ gate clock (where g is an integer of not less than 2, g=2 in the above example) counted from a gate clock at which a $1^{st}$ gate signal line GL1 is turned to the active level.

Thus, as shown in FIG. 4, the clock-skipping mode allows driving such that the $2^{nd}$ gate signal line GL2 is turned to the active level at the second gate clock counted from a gate clock at which the $1^{st}$ gate signal line GL1 is turned to the active level.

The gate driver section 23 includes: the $1^{st}$ to $3^{rd}$ gate drivers which are cascade-connected. See output timing of a gate start pulse GSP from the $1^{st}$ gate driver to the $2^{nd}$ gate driver in FIG. 4. In this case, the $1^{st}$ gate driver turns its final gate signal line GL ($360^{th}$ gate signal line GL360) to the active level. Then, in response to the next gate clock, the $1^{st}$ gate driver turns the gate signal line GL360 to the inactive level. Then, in response to the next gate clock, the $1^{st}$ gate driver outputs the gate start pulse GSP to the $2^{nd}$ gate driver in the next stage.

In this way, the $1^{st}$ gate signal line GL 361 of the $2^{nd}$ gate driver is varied to the active level at the timing of a gate clock subsequent to a gate clock at which the gate signal line GL 360 of the previous stage was turned to the active state. This gate driver clock-skipping mode allows successive control of the gate signal lines as if the connected three gate drivers are single gate driver.

It is preferable that the gate drivers constituting the gate driver section 23 are capable of switching between the clock-skipping mode and a normal mode ($2^{nd}$ driving mode) so as to support displaying in which a frame is not divided into subframes. The normal mode is such that the $2^{nd}$ gate signal line GL2 is turned to active level in response to a clock signal right after the gate clock at which the $1^{st}$ gate signal line GL1 is turned to the active level.

It is preferable that the value of g be variable in the gate drivers constituting the gate driver section 23. Specifically, the value of g is determined according to the number of subframes. When the number of subframes is 2, g=2. When the number of the subframes is 3, g=3. Accordingly, by allowing a change in the value of g, displaying with different numbers of subframes is possible.

The value of g may be changed by a user with a use of a switch, in accordance with an image to be displayed. Alternatively, if the display device is such that the number of subframes are set according to an image to be displayed, the display device may discriminate the type of the image signal, specify the number of subframes into which an input image signal is divided, and change the value of g according to the result of specifying the number.

The following describes a process of generating display signals of plural subframes from an image signal, the process performed in the individual-subframe grayscale conversion circuit 15 provided in the control device 10.

The individual-subframe grayscale conversion circuit 15 is not particularly illustrated. However, the individual-subframe grayscale conversion circuit 15 includes: a $1^{st}$ LUT (look-up table) which is a table for use as a reference when converting an image signal into a display signal of the $1^{st}$ subframe; and a $2^{nd}$ LUT which is a table for use as a reference when converting the image signal into a display signal of the $2^{nd}$ subframe.

Values in the $1^{st}$ and $2^{nd}$ LUTs are set as detailed below. Here, in the following example, the values are set so that the display signal of the $2^{nd}$ subframe produces a higher luminance than that produced by the display signal of the $1^{st}$ subframe. However, an opposite case is also possible.

Specifically, when the image signal represents a grayscale level which is not more than a predetermined threshold (i.e., represents a luminance value not more than that of the threshold), the value of the display signal of the $1^{st}$ subframe is set to a luminance value within a predetermined range of luminance values for dark-displaying. The value of the display signal of the $2^{nd}$ subframe is set according to the value of the display signal of the $1^{st}$ subframe and the grayscale value of the image signal. Here, the range of luminance values for the dark-displaying is not more than a predetermined grayscale level for the dark-displaying. When the predetermined grayscale level for the dark-displaying is at the lowest luminance value, the predetermined grayscale level is a grayscale level indicating the lowest luminance (black).

On the contrary, when the image signal represents a grayscale level which is not darker than a predetermined threshold (i.e., represents a luminance not less than that indicated by the threshold), the value of the display signal of the $2^{nd}$ subframe is set to a luminance value within a predetermined range of luminance values for bright-displaying. The value of the display signal of the $1^{st}$ subframe is set according to the value of the display signal of the $2^{nd}$ subframe and the grayscale value of the image signal. Here, the range of the bright-displaying is not less than a predetermined grayscale level for the bright-displaying. When the predetermined grayscale level for the bright-displaying is at the highest luminance value, the range is a grayscale level indicating the highest luminance (white).

Figure 6:
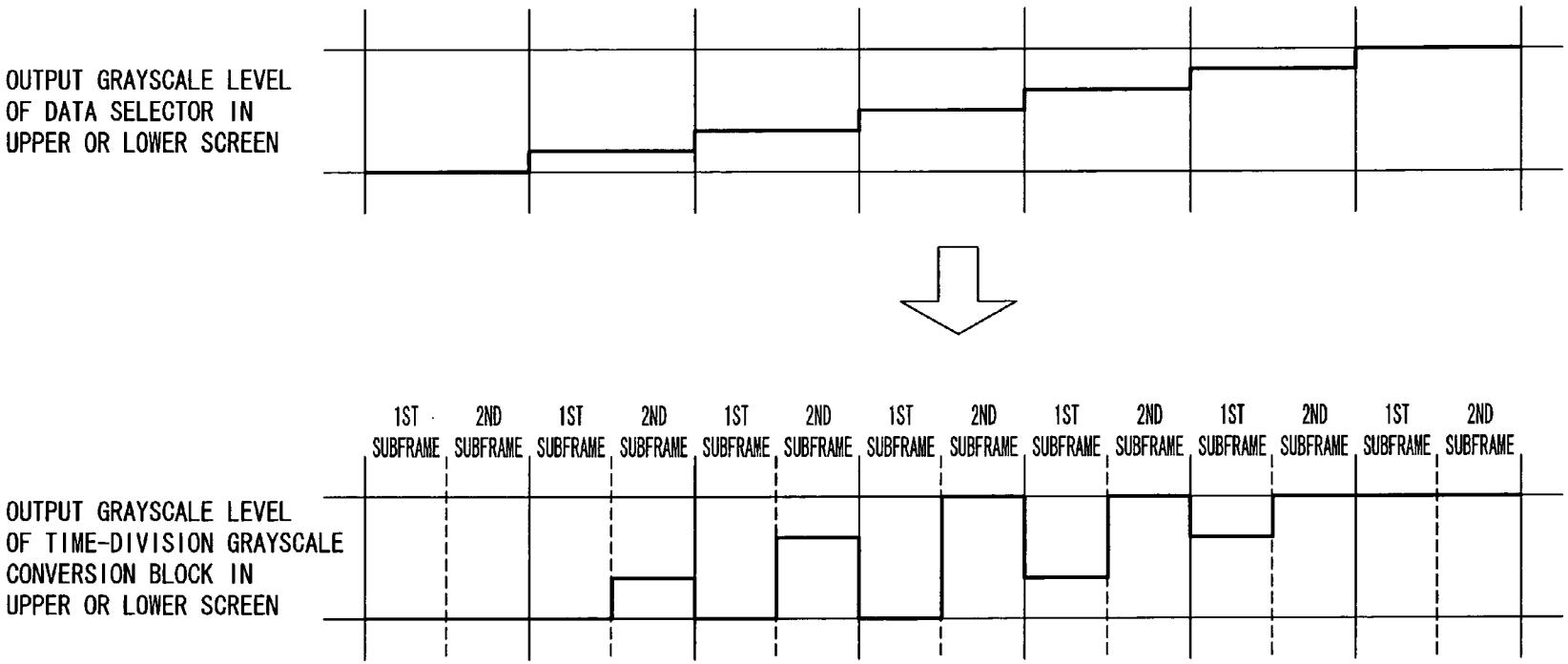
FIG. 6 is a diagram showing a relation between an input grayscale level and an output grayscale level in the image display device which performs a time-divisional driving.

FIG. 6 shows an example of conversion to yield displayed-grayscale levels of the $1^{st}$ and $2^{nd}$ subframes according to the grayscale level indicated by the image signal input to the individual-subframe grayscale conversion circuit 15.

When the grayscale level of the input image signal is high, the grayscale level of the input image signal is distributed to the both subframes. At this time, a largest possible difference is ensured between (i) a luminance integration value in a case of the highest grayscale level and (ii) a luminance integration value in a case of the lowest grayscale level. Further, in order to realize an impulse driving while avoiding deterioration in the contrast ratio, a high output grayscale level is distributed to the $2^{nd}$ subframe and a low grayscale level is distributed to the $1^{st}$ subframe to the greatest possible extent.

As a result, when an image signal of a frame for one pixel indicates a grayscale level of not more than the threshold (i.e. in a low luminance region), the level of the luminance for the pixel in the frame is mainly controlled by the value of the display signal in the $2^{nd}$ subframe.

Accordingly, the display state of the pixel can be brought to the dark-display state at least during the $1^{st}$ subframe period of the frame. Thus, when a grayscale level of an image signal of a frame is in the low luminance region, the light emission state of the pixel can be made similar to that in the case of the impulse-type light emission such as light emission of a CRT (Cathode-Ray Tube). As a result, the picture quality of video displayed on the pixel array 20 is improved.

Figure 7:
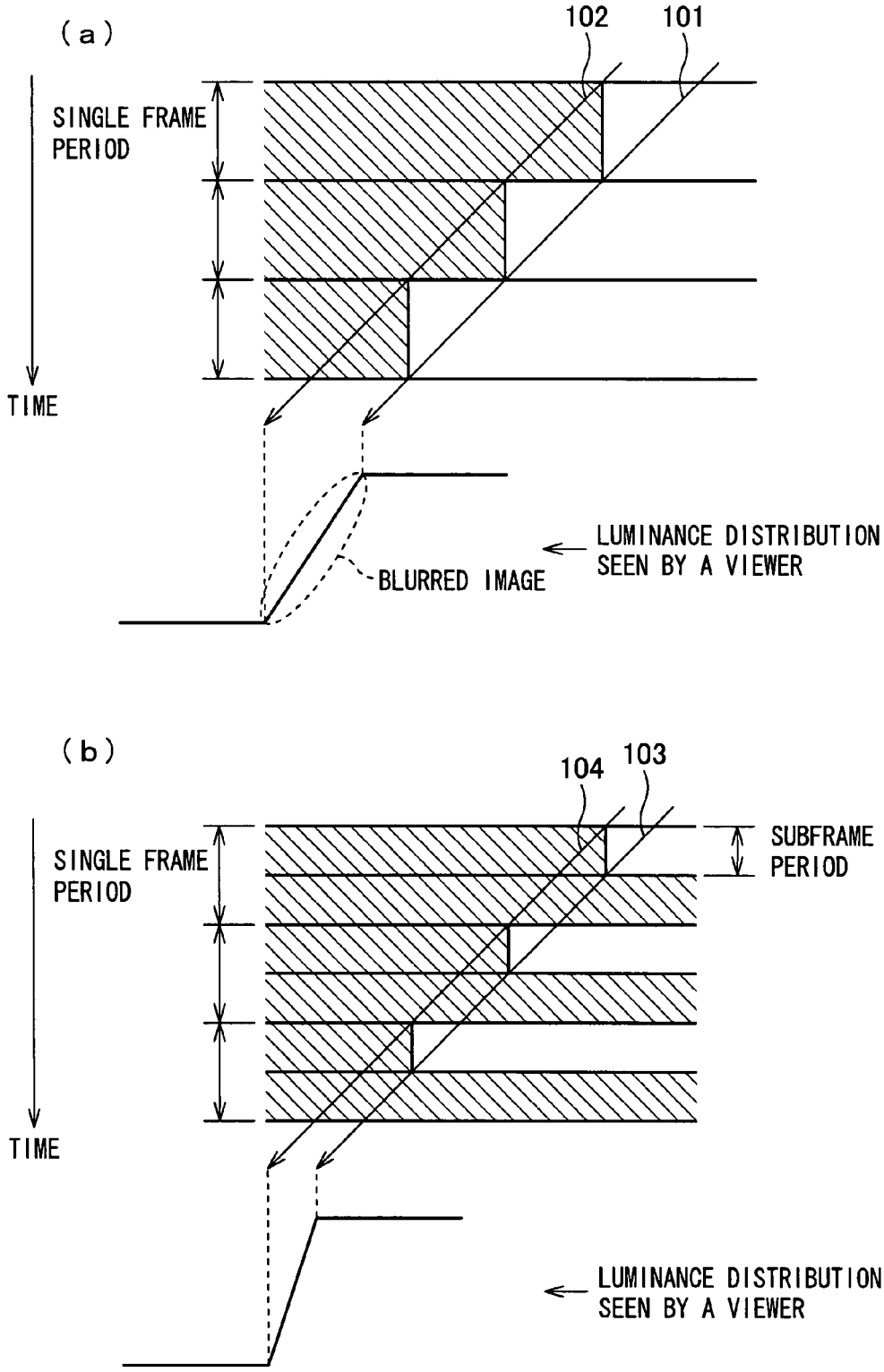
FIGS. 7(*a*) and 7(*b*) are diagrams each showing a reason why video blurring is restrained through an impulse driving.

Here, the following provides simple explanation on how video blurring is restrained by means of impulse driving, with reference to FIG. 7(*a*) and FIG. 7(*b*).

FIG. 7(*a*) shows how the boundary between two regions respectively having different luminances moves during the hold-type driving. The vertical axis is the time, and the horizontal axis is the position. Similarly, FIG. 7(*b*) shows how the boundary between two regions respectively having different luminances moves during the impulse-type driving. Note that a frame is divided into 2 subframes at a ratio of 1:1, in FIG. 7(*b*) showing the case of impulse-type driving.

When the boundary moves, the eye-gaze of a viewer moves along with the movement of the boundary. Here, the eye-gaze of the viewer is shown by the arrows 101 and 102 in FIG. 7(*a*). The luminance distribution seen by the viewer nearby the boundary is a time integration of displayed luminance along the movement of the viewer's eye-gaze. Thus, in the case of FIG. 7(*a*), the viewer senses that the luminance of the left region of the arrow 101 is the same as that of the region on the left of the boundary. Further, the viewer senses that the luminance of the right region of the arrow 102 is the same as that of the region on the right of the boundary. On the other hand, in the eyes of the viewer, the luminance in the region between the arrows 101 and 102 is sensed as if the luminance gradually increases. This is the part where the viewer recognizes as a blurred image.

Similarly, in the case of the impulse driving shown in FIG. 7(*b*), the distribution of the luminance nearby the boundary which distribution is seen by the viewer causes blurring of an image in the region between the arrows 103 and 104. However, since the region is slanted at a sharper angle than the case of the hold-type driving shown in FIG. 7(*b*), it is apparent that the blurring of image is reduced.

Thus, when an image signal of a frame for one pixel indicates a grayscale level of not more than the threshold (i.e. in a low luminance region), the level of the luminance for the pixel in the frame is mainly controlled by the value of the display signal in the $2^{nd}$ subframe. Accordingly, the display state of the pixel can be brought to the dark-display state at least during the $1^{st}$ subframe period of the frame. Thus, when a grayscale level of an image signal of a frame is in the low luminance region, the light emission state of the pixel can be made similar to that in the case of the impulse-type light emission such as light emission of a CRT (Cathode-Ray Tube). As a result, the picture quality of video displayed on the pixel array 20 is improved.

Further, when an image signal of a frame for a pixel indicates a grayscale level of more than the threshold (i.e. in a high luminance region), the level of the luminance for the pixel in the frame is mainly controlled by the value of the display signal in the $1^{st}$ subframe. Accordingly, the difference between respective luminances of the $1^{st}$ and $2^{nd}$ subframes can be set larger than the case where the luminance is distributed to the $1^{st}$ and $2^{nd}$ subframes substantially equally. Thus, in almost any case, when a grayscale level of an image signal for a frame is in the high luminance region, the light emission state of the pixel can be made similar to that in the case of the impulse-type light emission such as light emission of a CRT (Cathode-Ray Tube) as in the above case. As a result, the picture quality of video displayed on the pixel array 20 is improved.

The present embodiment deals with a case of performing a time-division grayscale conversion by means of impulse driving, for the purpose of reducing video blurring. However, the present invention is not limited by a method of grayscale conversion, and is applicable to any image display device which performs such a display driving that an input frame is divided into plural subframes.

Industrial Applicability

The present invention is applicable to drive devices for a wide variety of display devices such as liquid crystal television receivers or liquid crystal monitors.

The invention claimed is:

1. A method of displaying an image, the method comprising:

dividing a single frame of an input image signal which is input to a drive control device into $1^{st}$ to nth subframes (where n is an integer of not less than 2) in a time-divisional manner;

displaying the input image signal associated with a $1^{st}$ subframe of an $N^{th}$ frame (N is an integer of not less than 2) such that a period overlaps at least (i) a part of a display period of the input image signal associated with a $2^{nd}$ subframe of the $N^{th}$ frame and (ii) a part of a display period of the input image signal associated with the nth subframe of an $(N-1)^{th}$ frame, and for each of the subframes, a period of writing a pixel voltage corresponding to the input image signal into all horizontal lines in a display screen equals an image signal input period for inputting a single frame of the image signal;

inputting the $N^{th}$ frame of the image signal for the horizontal lines to the drive control device; and writing the pixel voltage to the horizontal lines in the $1^{st}$ subframe of the $N^{th}$ frame such that a delay period between the inputting of the $N^{th}$ frame to the drive control device and writing the pixel voltage is shorter than a half of a single frame period of the image signal.

2. The method as set forth in claim 1, comprising the steps of:

generating, from the input signal, a display signal of the $1^{st}$ subframe without a use of a frame memory for storing the input image signal; and generating display signals of the $2^{nd}$ to nth subframes by reading out the image signal stored in the frame memory.

3. The method as set forth in claim 1, wherein:

for each of the $1^{st}$ to nth subframes, a period from (i) writing of the pixel voltage of one subframe into the horizontal lines of the screen to (ii) writing of the pixel voltage of a next subframe into the horizontal lines is the same.

4. A method of displaying an image, the method comprising:

dividing a single frame of an input image signal which is input to a drive control device_into $1^{st}$ to nth subframes (where n is an integer of not less than 2) in a time-divisional manner;

displaying the input image signal associated with a $1^{st}$ subframe of an $N^{th}$ frame (N is an integer of not less than 2) such that a period overlaps at least (i) a part of a display period of the input image signal associated with a $2^{nd}$ subframe of the $N^{th}$ frame and (ii) a part of a display period of the input image signal associated with the nth subframe of an $(N-1)^{th}$ frame;

writing a pixel voltage corresponding to the input image signal_to all horizontal lines in a display screen such that for each of the subframes a period equals an image signal input period for inputting a single frame of the image signal;

inputting the $N^{th}$ frame of the image signal for the horizontal lines to the drive control device; and writing the pixel voltage to the horizontal lines in the $1^{st}$ subframe of the $N^{th}$ frame such that a delay period between the inputting of the $N^{th}$ frame to the drive control device and writing the pixel voltage is shorter than 20% of a single frame period of the image signal.

5. The method as set forth in claim 4, comprising the steps of:

generating, from the input signal, a display signal of the $1^{st}$ subframe without a use of a frame memory for storing the input image signal; and generating display signals of the $2^{nd}$ to nth subframes by reading out the image signal stored in the frame memory.

6. The method as set forth in claim 4, wherein:

for each of the $1^{st}$ to nth subframes, a period from (i) writing of the pixel voltage of one subframe into the horizontal lines of the screen to (ii) writing of the pixel voltage of a next subframe into the horizontal lines is the same.

7. A drive control device of a display device for displaying an image, in which a single frame of an input image signal is divided into $1^{st}$ to nth subframes (where n is an integer of not less than 2) in a time-divisional manner, the drive control device comprising:

a signal generator to generate a display signal of each of the $1^{st}$ to nth subframes based on the input image signal; and a timing controller to generate a control signal to cause a display screen of a display module to perform image displaying using the display signal of each of the $1^{st}$ to nth subframes, wherein the timing controller generates the control signal such that:

a period of displaying the input image signal associated with a $1^{st}$ subframe of an $N^{th}$ frame (N is an integer of not less than 2) overlaps at least (i) a part of a display period of the input image signal associated with a $2^{nd}$ subframe of the $N^{th}$ frame and (ii) a part of a display period of the input image signal associated with the nth subframe of an $(N-1)^{th}$ frame;

for each of the subframes, a period of writing a pixel voltage corresponding to the input image signal to all horizontal lines in the display screen equals an image signal input period for inputting a single frame of the image signal; and a delay period from (i) inputting of the $N^{th}$ frame of the image signal for the horizontal lines to the drive control device_to (ii) writing of the pixel voltage to the horizontal lines in the $1^{st}$ subframe of the $N^{th}$ frame is shorter than a half of a single frame period of the image signal.

8. The drive control device as set forth in claim 7, wherein:

the timing controller generates the control signal such that (i) the pixel voltage associated with the display signal of each of the $1^{st}$ to nth subframes is output in a time-divisional manner for one horizontal line at a time, and (ii) a selection signal is output in response to the pixel voltage.

9. The drive control device as set forth in claim 7, further comprising:

a memory controller to control writing/reading of the input image signal to/from a frame memory for storing the input image signal, wherein when the display signal of the nth subframe for one pixel is generated, the memory controller writes an input image signal for another pixel into a region of the frame memory in which region the image signal corresponding to that one pixel is stored.

10. The drive control device as set forth in claim 7, wherein:

in a frame memory to store the input image signal, a size of an address space used for displaying a single frame of a still image on the screen, based on the image signal corresponding to the single frame, covers 50% or more of the screen but less than the entire screen.

11. The drive control device as set forth in claim 7, wherein:

the signal generator generates the display signal of the $1^{st}$ subframe from the input image signal without a use of the frame memory for storing the input image signal, and a display signal of each of the $2^{nd}$ to nth subframes by reading out the image signal stored in the frame memory.

12. The drive control device as set forth in claim 7, wherein:

for the $1^{st}$ subframe, the timing controller does not change the delay period even if a single frame period of the input image signal varies; and for each of the $2^{nd}$ to nth subframes, the timing controller does not change the delay period if the single frame period of the input image signal varies by less than a reference value, but changes the delay period if the single frame period of the input image signal varies by the reference value or more, the delay period being a period from (i) inputting of the $N^{th}$ frame of the image signal for the horizontal lines to (ii) writing of the pixel voltage into the horizontal lines in the $1^{st}$ subframe of the $N^{th}$ frame.

13. A display device, comprising;

the drive control device as set forth in claim 7; and a display module controlled by the drive control device.

14. The display device as set forth in claim 13, comprising:

image receiving means for receiving television broadcasting and for inputting, to the drive control device, an image signal representing an image transferred by means of television broadcasting, wherein the display module is a liquid crystal display module, and the display device operates as a liquid crystal television receiver.

15. The display device as set forth in claim 13, wherein:

the display module is a liquid crystal display module;

to the control device, the image signal is input from outside; and the display device operates as a liquid crystal monitor device which displays an image represented by the image signal.

16. A drive control device of a display device for displaying an image, in which a single frame of an input image signal is divided into $1^{st}$ to nth subframes (where n is an integer of not less than 2), the drive control device comprising:

a signal generator to generate a display signal of each of the $1^{st}$ to nth subframes based on the input image signal; and a timing controller to generate a control signal to cause a display screen of a display module to perform image displaying using the display signal of each of the $1^{st}$ to nth subframes, wherein the timing controller generates the control signal se such that:

a period of displaying the input image signal associated with a $1^{st}$ subframe of an $N^{th}$ frame (N is an integer of not less than 2) overlaps at least (i) a part of a display period of the input image signal associated with a $2^{nd}$ subframe of the $N^{th}$ frame and (ii) a part of a display period of the input image signal associated with the nth subframe of an $(N-1)^{th}$ frame;

for each of the subframes, a period of writing a pixel voltage corresponding to the input image signal to all horizontal lines in the display screen equals an image signal input period for inputting a single frame of the image signal; and a delay period from (i) inputting of the $N^{th}$ frame of the image signal for the horizontal lines to the drive control device_to (ii) writing of the pixel voltage to the horizontal lines in the $1^{st}$ subframe of the $N^{th}$ frame is shorter than 20% of a single frame period of the image signal.

17. The drive control device as set forth in claim 16, wherein:

the timing controller generates the control signal such that (i) the pixel voltage associated with the display signal of each of the $1^{st}$ to nth subframes is output in a time-divisional manner for one horizontal line at a time, and (ii) a selection signal is output in response to the pixel voltage.

18. The drive control device as set forth in claim 16, further comprising:

a memory controller to control writing/reading of the input image signal to/from a frame memory for storing the input image signal, wherein when the display signal of the nth subframe for one pixel is generated, the memory controller writes an input image signal for another pixel into a region of the frame memory in which region the image signal corresponding to that one pixel is stored.

19. The drive control device as set forth in claim 16, wherein:

in a frame memory to store the input image signal, a size of an address space used for displaying a single frame of a still image on the screen, based on the image signal corresponding to the single frame, covers 50% or more of the screen but less than the entire screen.

20. The drive control device as set forth in claim 16, wherein:

the signal generator generates the display signal of the $1^{st}$ subframe from the input image signal without a use of the frame memory for storing the input image signal, and a display signal of each of the $2^{nd}$ to nth subframes by reading out the image signal stored in the frame memory.

21. The drive control device as set forth in claim 16, wherein:

for the $1^{st}$ subframe, the timing controller does not change the delay period even if a single frame period of the input image signal varies; and for each of the $2^{nd}$ to nth subframes, the timing controller does not change the delay period if the single frame period of the input image signal varies by less than a reference value, but changes the delay period if the single frame period of the input image signal varies by the reference value or more, the delay period being a period from (i) inputting of the $N^{th}$ frame of the image signal for the horizontal lines to (ii) writing of the pixel voltage into the horizontal lines in the $1^{st}$ subframe of the $N^{th}$ frame.

22. A display device, comprising;

the drive control device as set forth in claim 16; and a display module controlled by the drive control device.

23. The display device as set forth in claim 22, comprising:

image receiving means for receiving television broadcasting and for inputting, to the drive control device, an image signal representing an image transferred by means of television broadcasting, wherein the display module is a liquid crystal display module, and the display device operates as a liquid crystal television receiver.

24. The display device as set forth in claim 22, wherein:

the display module is a liquid crystal display module;

to the control device, the image signal is input from outside; and the display device operates as a liquid crystal monitor device which displays an image represented by the image signal.

* * * * *